US010981697B1

(12) United States Patent
Jaffa

(10) Patent No.: US 10,981,697 B1
(45) Date of Patent: Apr. 20, 2021

(54) STACKABLE SPRAY BOTTLE, REFILL POD AND ASSOCIATED USE THEREOF

(71) Applicant: Andrew Jaffa, Jacksonville, FL (US)

(72) Inventor: Andrew Jaffa, Jacksonville, FL (US)

( * ) Notice: Subject to any disclaimer, the term of this patent is extended or adjusted under 35 U.S.C. 154(b) by 46 days.

(21) Appl. No.: 15/970,958

(22) Filed: May 4, 2018

Related U.S. Application Data

(60) Provisional application No. 62/501,366, filed on May 4, 2017.

(51) Int. Cl.
*B65D 21/02* (2006.01)
*B05B 1/00* (2006.01)
*B65D 23/10* (2006.01)

(52) U.S. Cl.
CPC ..... *B65D 21/023* (2013.01); *B05B 1/00* (2013.01); *B65D 23/10* (2013.01)

(58) Field of Classification Search
CPC ..... B65D 21/0212; B65D 21/023; B65D 21/0231; B65D 21/0202; B65D 23/10; B05B 1/00
USPC ..... 220/23.6, 380, 4.26, 4.27, 781; 222/143; 206/509, 510, 503, 508, 504
See application file for complete search history.

(56) References Cited

U.S. PATENT DOCUMENTS 4,881,647 A * 11/1989 Schiemann ..... B65D 41/04 206/510
2004/0112926 A1* 6/2004 Barnett ..... B65D 21/0231 222/530
2015/0166250 A1* 6/2015 Brace ..... B65D 83/226 220/260

* cited by examiner

*Primary Examiner* — James N Smalley
*Assistant Examiner* — Elizabeth J Volz
(74) *Attorney, Agent, or Firm* — Ashkan Najafi

(57) ABSTRACT

A stackable spray bottle assembly includes a top stackable spray bottle and a bottom stackable spray bottle detachably engaged therewith. Each of the top stackable spray bottle and the bottom stackable spray bottle include a reservoir having an open top portion and a closed bottom portion, and an accessory removably coupled to the open top portion. Advantageously, the accessory has a first silhouette, and the bottom portion has a second silhouette conforming to the first silhouette such that, during storage, the top stackable spray bottle is maintained at a substantially stable position when stacked on top of the bottom stackable spray bottle.

13 Claims, 25 Drawing Sheets

STACKABLE SPRAY BOTTLE, REFILL POD AND ASSOCIATED USE THEREOF

CROSS REFERENCE TO RELATED APPLICATIONS

This is a non-provisional patent application that claims the benefit of U.S. provisional patent application No. 62/501,366 filed May 4, 2017, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to stackable reservoirs and, more particularly, to a handheld, stackable, liquid spray bottle including a top portion containing a spray mechanism appropriately contoured to engage and mate with a bottom portion of another spray bottle stacked thereon. Additionally, replacement fluid-housing containers are suitably sized and shaped so that a bottom portion of a first replacement container stacks on a top portion of a second replacement container. The spray bottle may be operated manually or it may be battery operated.

Prior Art

A conventional plastic spray bottle is a staple device found in nearly every home, business, and building as a means for dispensing liquids such as window cleaner, bathroom cleaner, all-purpose cleaner, tile cleaner, etc. The basic shape of the plastic spray bottle has remained virtually unchanged since its mass introduction in the late 1960's. The main benefits of conventional spray bottles include the following: 1. An ergonomic, balanced design that allows the user to easily hold the bottle and squeeze the trigger with one-handed operation 2. Left or right-handed use 3. Ability to dispense multiple types of chemicals. 4. Light, simple, durable construction that is inexpensive to manufacture.

Due to the ubiquity of conventional spray bottles, most spray bottle innovations have involved only slight modifications to the original design. These modifications include improved materials, more ergonomic shapes, improved spray mechanisms, more robust designs, etc. The basic shape, however, still includes a tapered spray bottle and a top-mounted spray mechanism that has a smaller profile than the bottle. Such non-conforming top and bottom portions of the spray inherently require most spray bottles to be stacked in a horizontal configuration rather than a vertical configuration.

Accordingly, a need remains for a handheld, stackable, liquid spray bottle in order to overcome at least one aforementioned shortcoming. The exemplary embodiment(s) satisfy such a need by providing a handheld, stackable, liquid spray bottle that is convenient and easy to use, lightweight yet durable in design, versatile in its applications, and designed for including a top portion containing a spray mechanism appropriately contoured to engage and mate with a bottom portion of another spray bottle stacked thereon. Additionally, replacement fluid-housing containers are suitably sized and shaped so that a bottom portion of a first replacement container stacks on a top portion of a second replacement container. The spray bottle may be operated manually or it may be battery operated.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a handheld, stackable, liquid spray bottle including a top portion containing a spray mechanism appropriately contoured to engage and mate with a bottom portion of another spray bottle stacked thereon. Additionally, replacement fluid-housing containers are suitably sized and shaped so that a bottom portion of a first replacement container stacks on a top portion of a second replacement container. The spray bottle may be operated manually or it may be battery operated. These and other objects, features, and advantages of the non-limiting exemplary embodiment(s) are provided by a stackable spray bottle assembly for being vertically stacked during storage. Such a stackable spray bottle assembly includes a top stackable spray bottle and a bottom stackable spray bottle detachably engaged therewith. Each of the top stackable spray bottle and the bottom stackable spray bottle include a reservoir having an open top portion and a closed bottom portion, and an accessory removably coupled to the open top portion. Advantageously, the accessory has a first silhouette, and the bottom portion has a second silhouette conforming to the first silhouette such that, during storage, the top stackable spray bottle is maintained at a substantially stable position when stacked on top of the bottom stackable spray bottle. Notably, the reservoir has an interior volume greater than an interior volume of the accessory.

In a non-limiting exemplary embodiment, the accessory includes one of a power-actuated trigger mechanism and a manually-actuated trigger mechanism.

In a non-limiting exemplary embodiment, the accessory includes an end cap having the first silhouette.

In a non-limiting exemplary embodiment, the first silhouette of the bottom stackable spray bottle includes a plurality of triangular protrusions extended upwardly away from the accessory. Such triangular protrusions are spaced apart and have a planar top surface and a contoured outer perimeter edge beginning at the accessory and terminated at the planar top surface. Advantageously, the second silhouette of the top stackable spray bottle includes a plurality of triangular depressions extended upwardly towards the first silhouette. Such triangular depressions are spaced apart and having a planar bottom surface and a contoured outer perimeter edge beginning at the bottom portion and terminated at the planar bottom surface. In this manner, during storage, each of the triangular depressions of the top stackable spray bottle are removably nested directly on the triangular protrusions of the bottom stackable spray bottle, respectively.

In a non-limiting exemplary embodiment, the first silhouette of the bottom stackable spray bottle includes a plurality of rectilinear protrusions extended upwardly away from the accessory. Such rectilinear protrusions are spaced apart and registered parallel to each other wherein each of the rectilinear protrusions has an arcuate top surface extended along an entire longitudinal length thereof. A handle having a dome-shaped top face is intermediately positioned between the rectilinear protrusions and extended parallel to the rectilinear protrusions. Advantageously, the second silhouette of the top stackable spray bottle includes a plurality of rectilinear depressions extended upwardly away from the accessory. Such rectilinear depressions are spaced apart and registered parallel to each other. Notably, each the rectilinear depression has an arcuate top surface extended along an entire longitudinal length thereof. A dome-shaped handle-receiving channel is intermediately positioned between the rectilinear depressions and extended parallel to the rectilinear depressions. In this manner, during storage, each of the rectilinear depressions and the dome-shaped handle-receiving channel of the top stackable spray bottle are removably nested directly on the rectilinear protrusions and the handle of the bottom stackable spray bottle, respectively.

In a non-limiting exemplary embodiment, the first silhouette of the bottom stackable spray bottle includes a boomerang-shaped protrusion extended upwardly away from the accessory thereof. Such a boomerang-shaped protrusion covers a major surface area of a top surface of the accessory. Notably, the boomerang-shaped protrusion has a planar top surface and a contoured outer perimeter edge beginning at the accessory and terminated at the planar top surface. Advantageously, the second silhouette of the top stackable spray bottle includes a boomerang-shaped depression extended upwardly towards the accessory thereof. Such a boomerang-shaped depression covers a major surface area of the bottom portion. Notably, the boomerang-shaped depression has a planar bottom surface and a contoured outer perimeter edge beginning at the bottom portion and terminated at the planar bottom surface. Advantageously, during storage, the boomerang-shaped depression of the top stackable spray bottle is removably nested directly on the boomerang-shaped protrusion of the bottom stackable spray bottle, respectively.

In a non-limiting exemplary embodiment, bottom stackable spray bottle includes a generally square-shaped protrusion extended upwardly away from the accessory thereof. Such a generally square-shaped protrusion covering a major surface area of a top surface of the accessory, and the generally square-shaped protrusion has a planar top surface and a contoured outer perimeter edge beginning at the accessory and terminated at the planar top surface. Advantageously, the second silhouette of the top stackable spray bottle includes a generally square-shaped depression extended upwardly towards the accessory thereof. Such a generally square-shaped depression covers a major surface area of the bottom portion. Notably, the generally square-shaped depression has a planar bottom surface and a contoured outer perimeter edge beginning at the bottom portion and terminated at the planar bottom surface. Advantageously, during storage, the generally square-shaped depression of the top stackable spray bottle is removably nested directly on the generally square-shaped protrusion of the bottom stackable spray bottle, respectively.

In a non-limiting exemplary embodiment, the first silhouette of the end cap of the bottom stackable spray bottle has a circular-shaped protrusion extended upwardly away from the accessory thereof. Such a circular-shaped protrusion covers a minor surface area of a top surface of the accessory. Notably, the circular-shaped protrusion has a planar top surface and an annular circumferential edge terminated at the planar top surface. Advantageously, the second silhouette of the top stackable spray bottle includes a circular-shaped depression extended upwardly towards the accessory thereof. Such circular-shaped depression covers a minor surface area of the bottom portion. Notably, the circular-shaped depression has a planar bottom surface and an annular circumferential edge terminated at the planar bottom surface, and a substantially square-shaped depression contiguously positioned with the circular-shaped depression. In this manner, the substantially square-shaped depression and the circular-shaped depression cover a major surface area of the bottom portion. Notably, the substantially square-shaped depression having a height that is lesser than a height of the circular-shaped depression. Advantageously, during storage, the circular-shaped depression of the top stackable spray bottle is removably nested directly on the circular-shaped protrusion of the bottom stackable spray bottle, respectively, such that a gap is formed between the top surface of the accessory and the substantially square-shaped depression.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
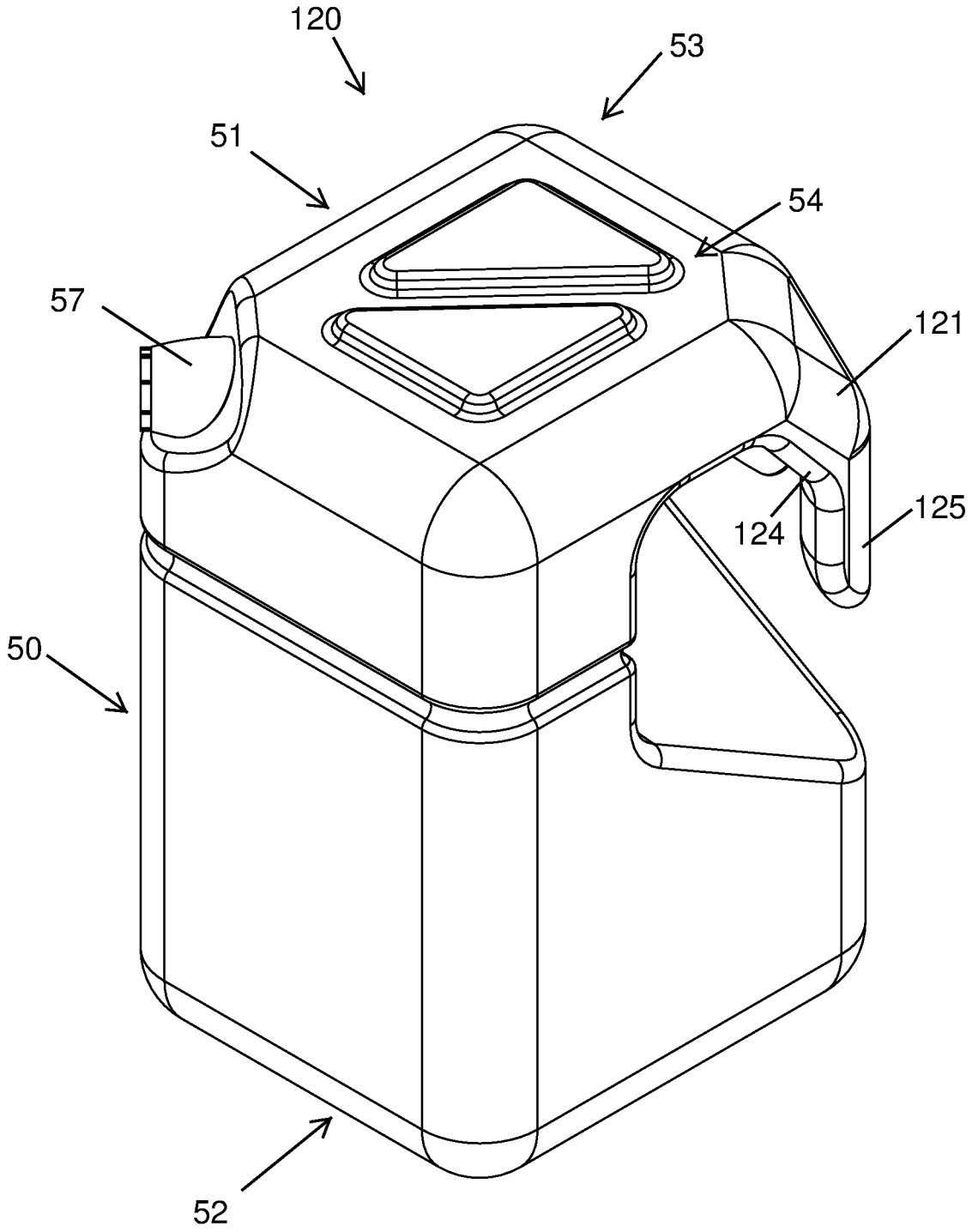
FIG. 1 is a perspective view of a stackable, spray bottle, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

Figure 2:
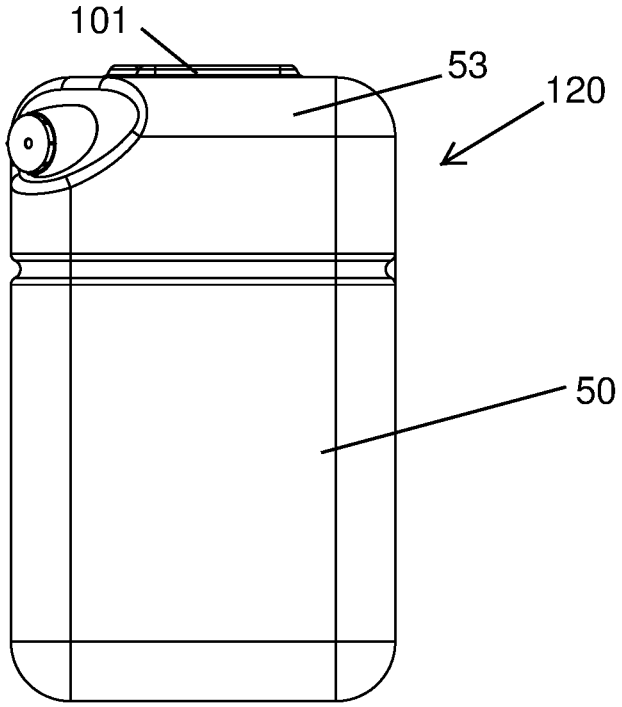
FIG. 2 is a front elevational view of the stackable, spray bottle shown in FIG. 1.
Figure 3:
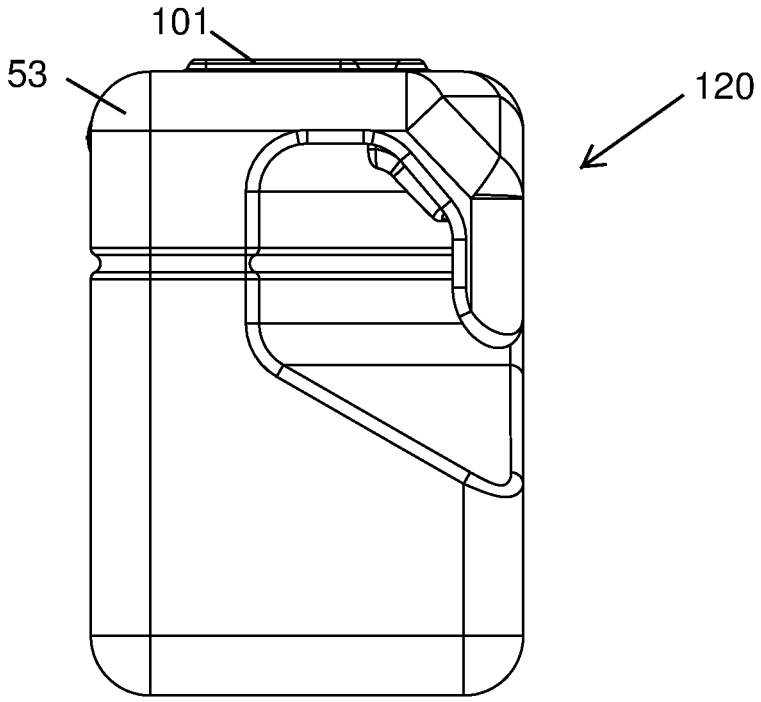
FIG. 3 is a side elevational view of the stackable, spray bottle shown in FIG. 1.
Figure 4:
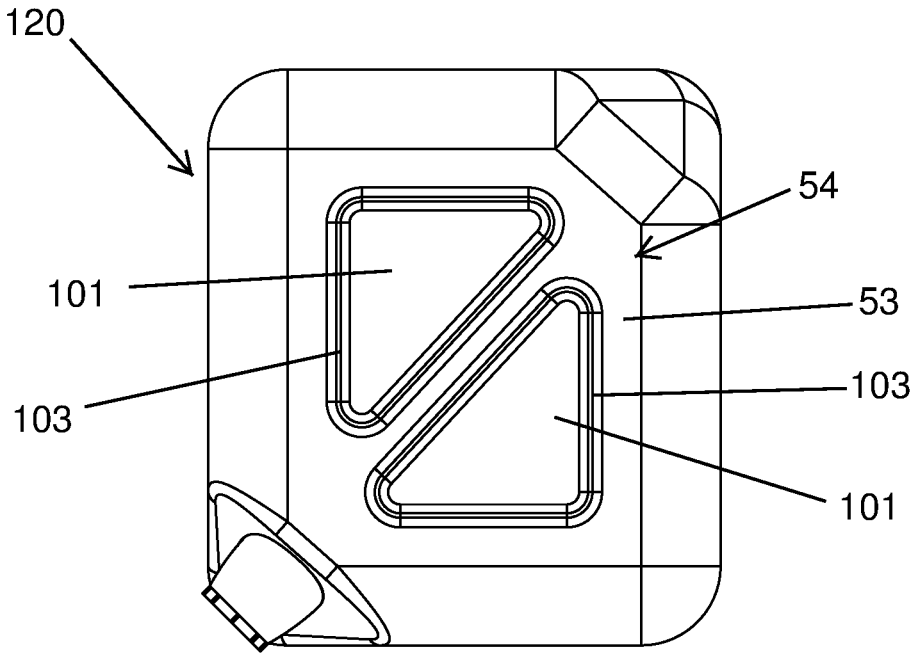
FIG. 4 is a top plan view of the view of stackable, spray bottle shown in FIG. 1.
Figure 5:
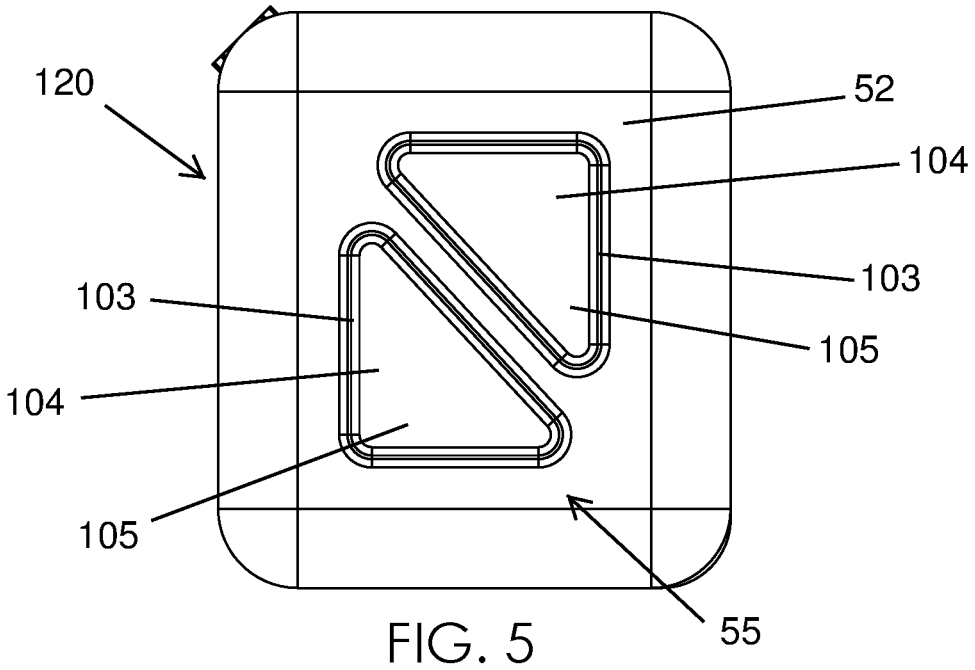
FIG. 5 is a bottom plan view of the view of stackable, spray bottle shown in FIG. 1.
Figure 6:
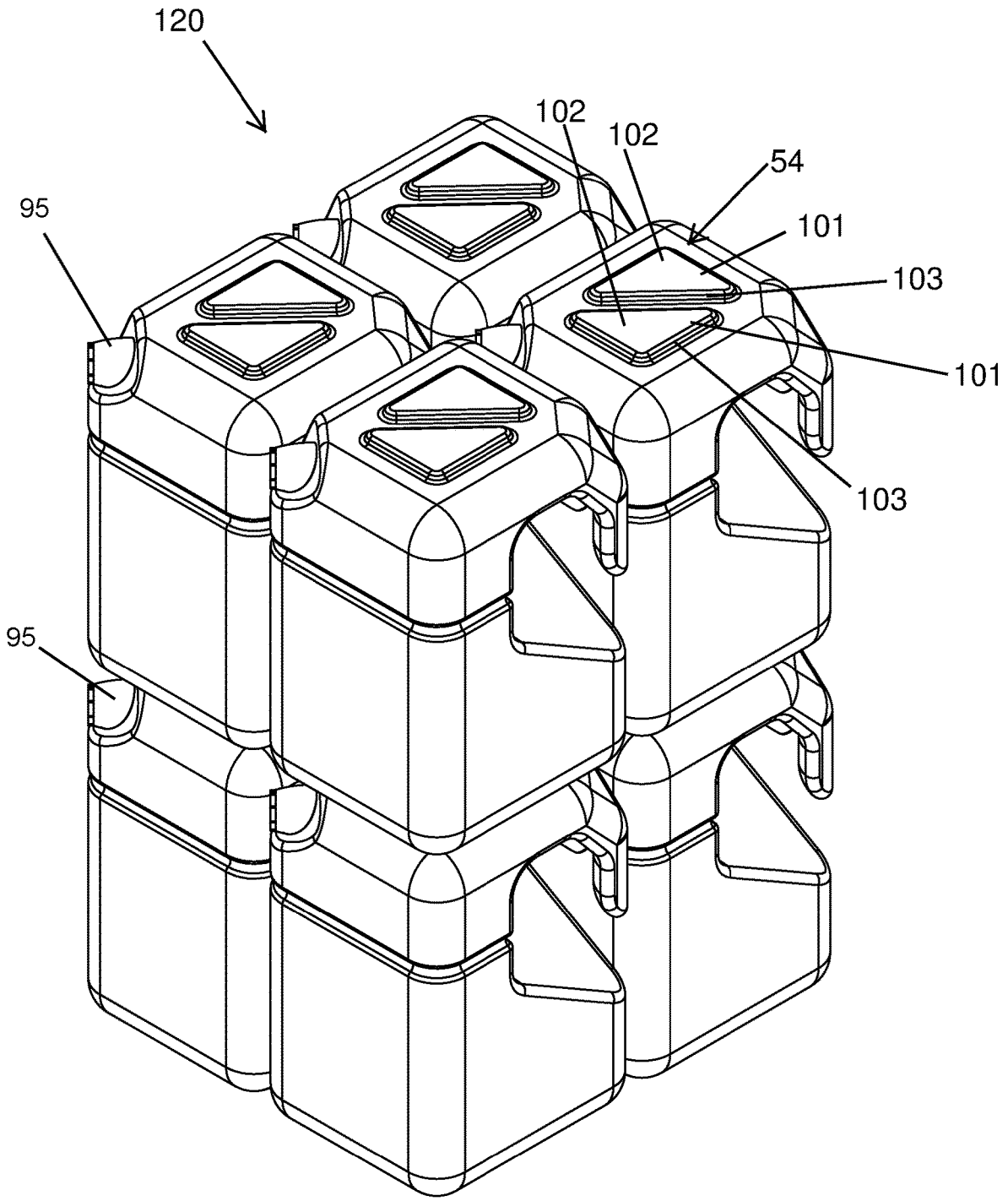
FIG. 6 is a perspective view of a group of stacked, spray bottles shown in FIG. 1.
Figure 7:
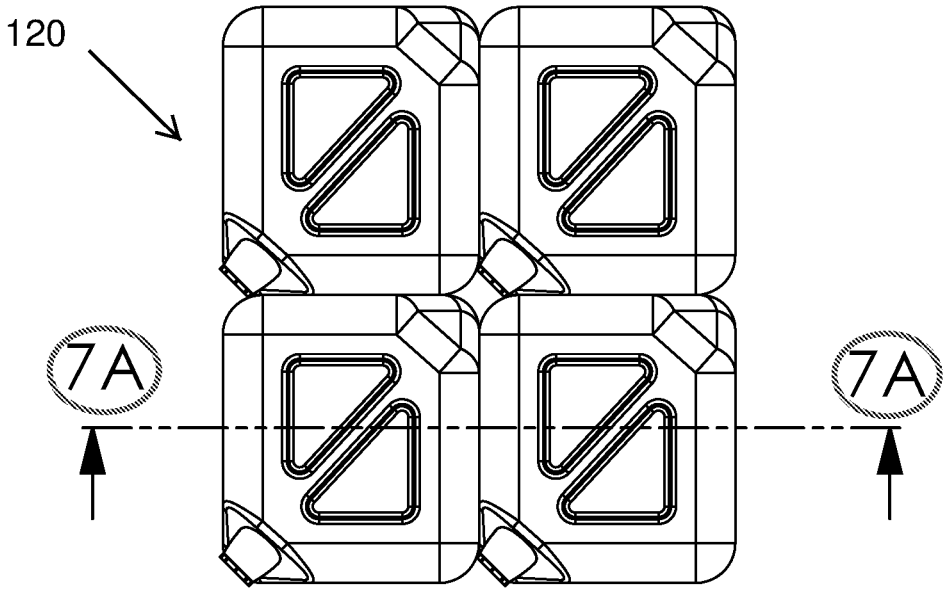
FIG. 7 is a top plan view of the group of stacked, spray bottles shown in FIG. 6.
Figure 8:
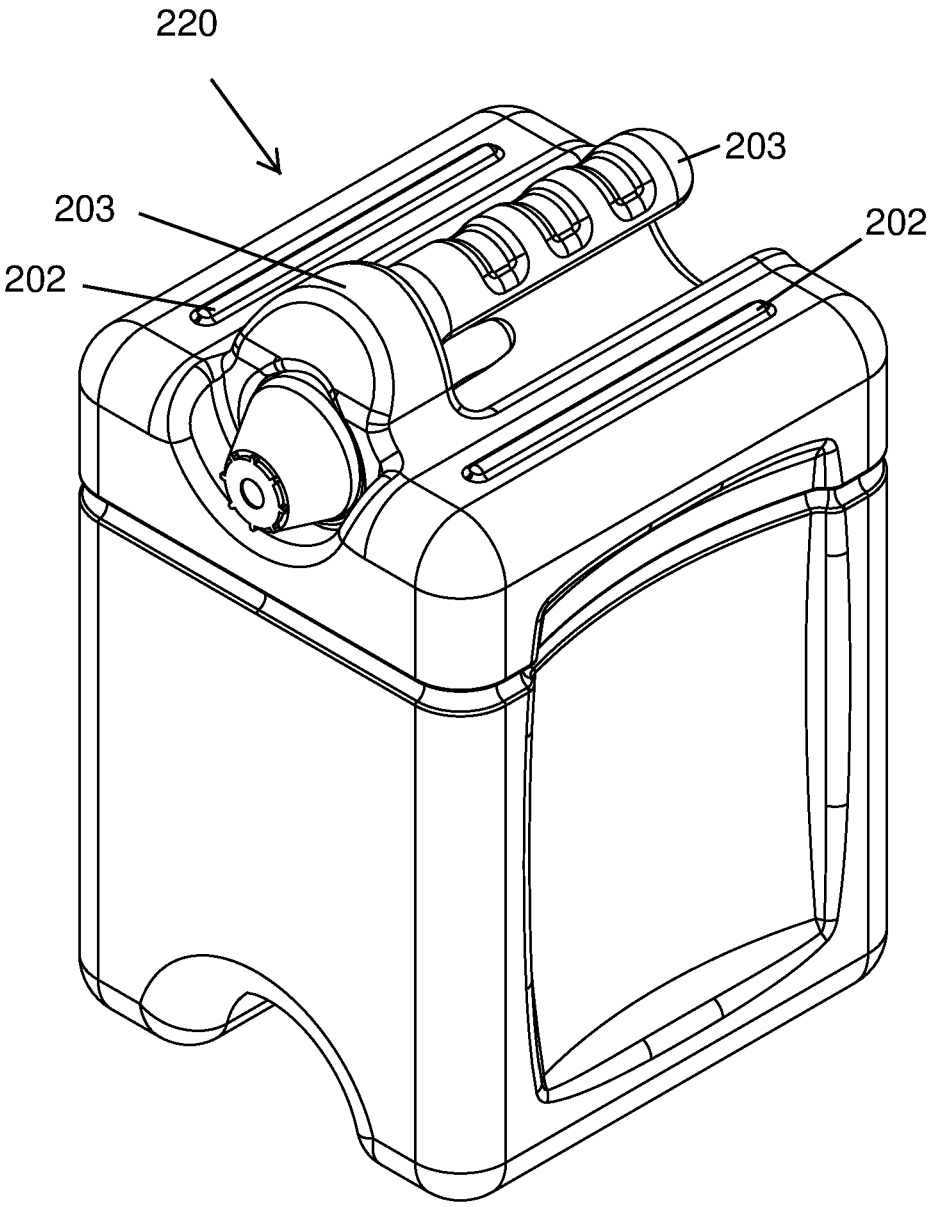
FIG. 8 is a perspective view of a stackable, spray bottle, in accordance with another non-limiting exemplary embodiment of the present disclosure.
Figure 9:
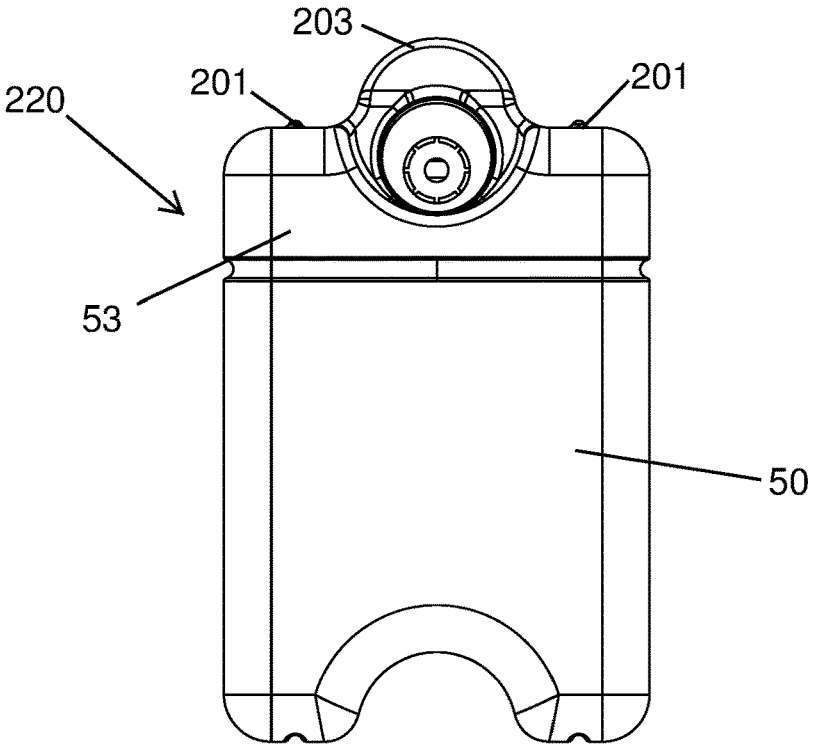
FIG. 9 is a front elevational view of the stackable, spray bottle shown in FIG. 8.
Figure 10:
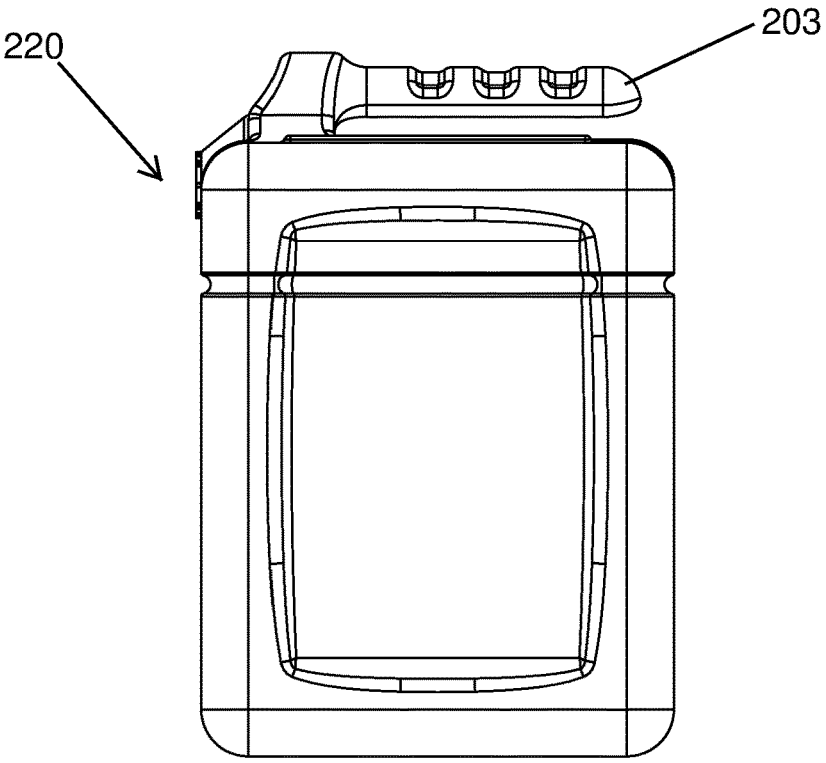
FIG. 10 is a side elevational view of the stackable, spray bottle shown in FIG. 8.
Figure 11:
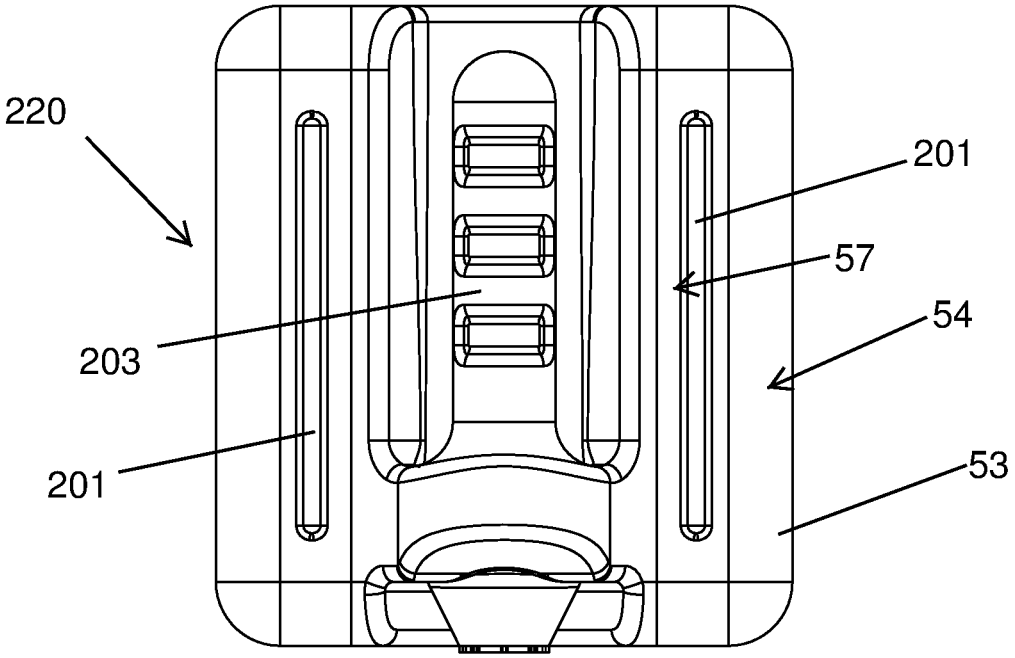
FIG. 11 is a top plan view of the view of stackable, spray bottle shown in FIG. 8.
Figure 12:
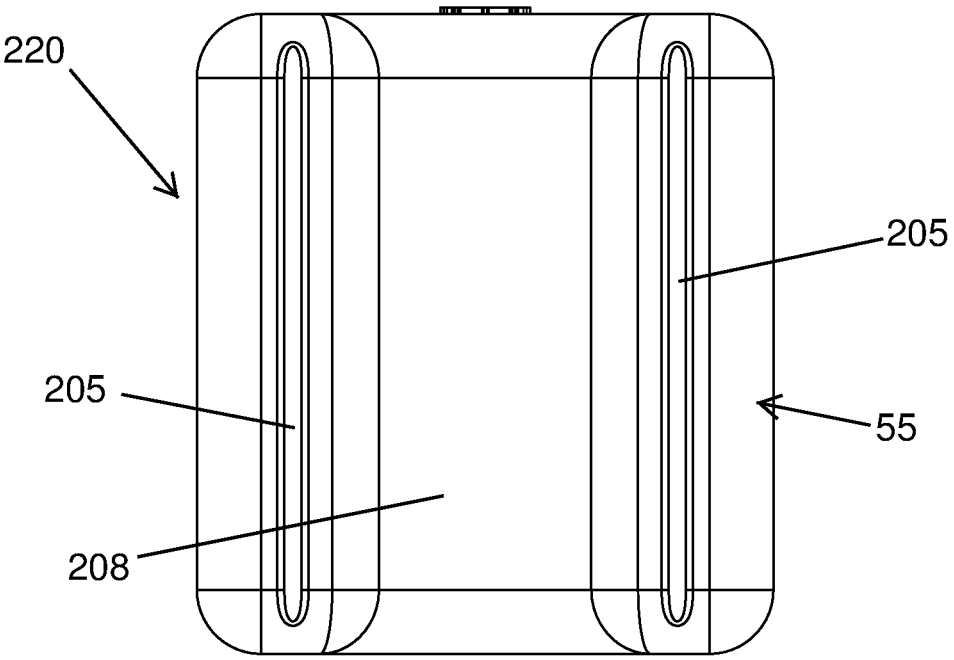
FIG. 12 is a bottom plan view of the view of stackable, spray bottle shown in FIG. 8.
Figure 13:
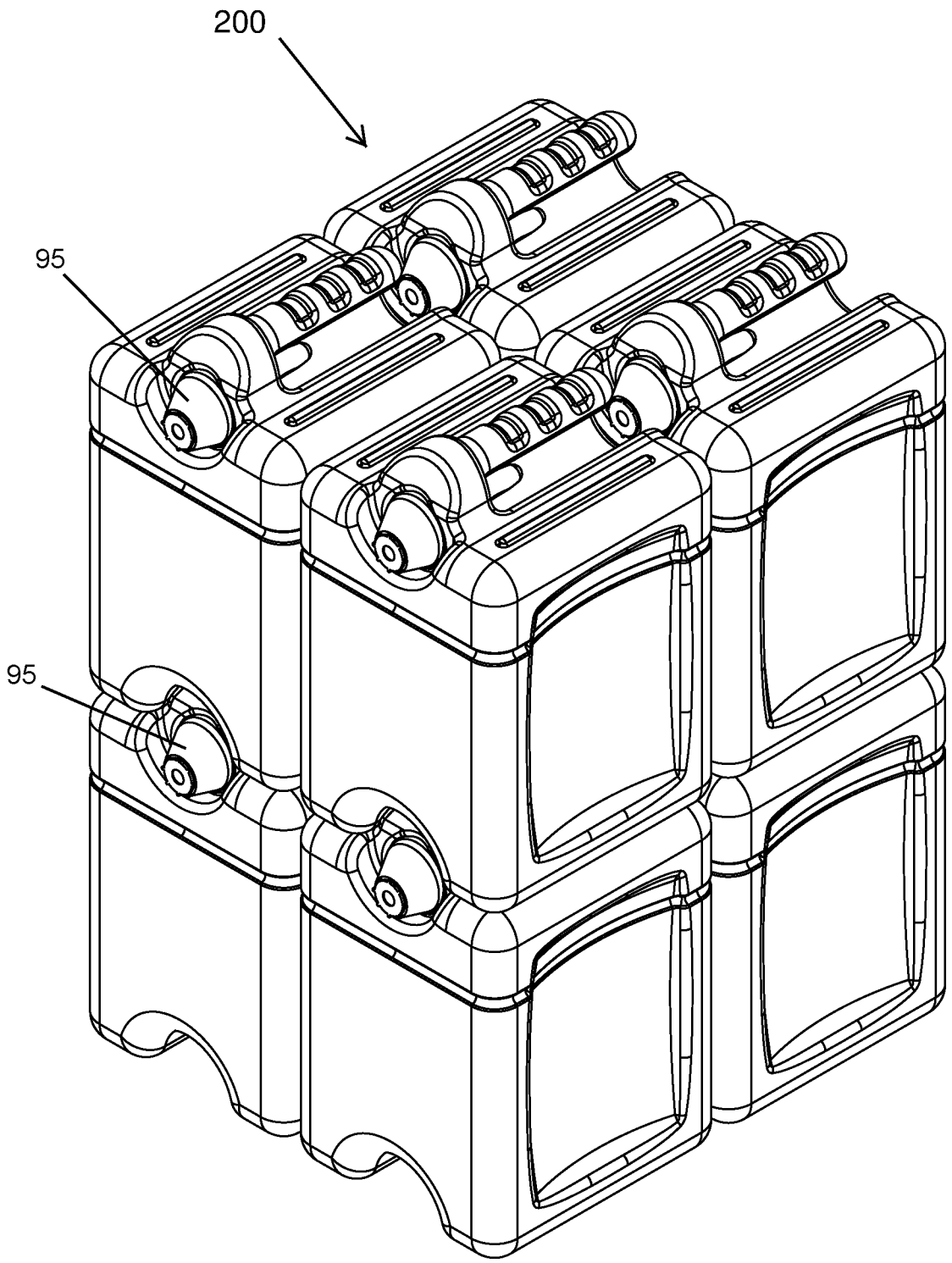
FIG. 13 is a perspective view of a group of stacked, spray bottles shown in FIG. 8.
Figure 14:
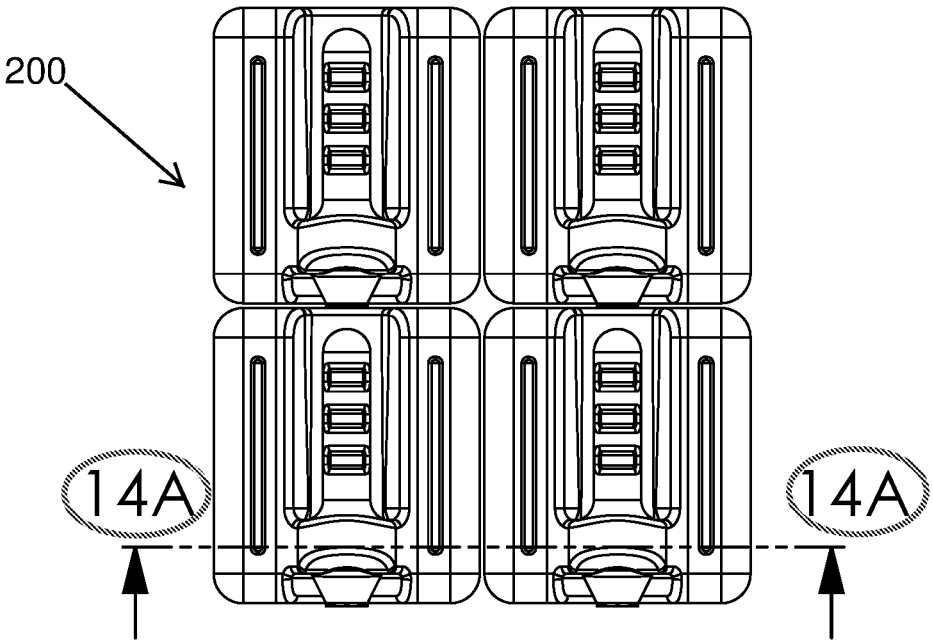
FIG. 14 is a top plan view of the group of stacked, spray bottles shown in FIG. 13.
Figure 15:
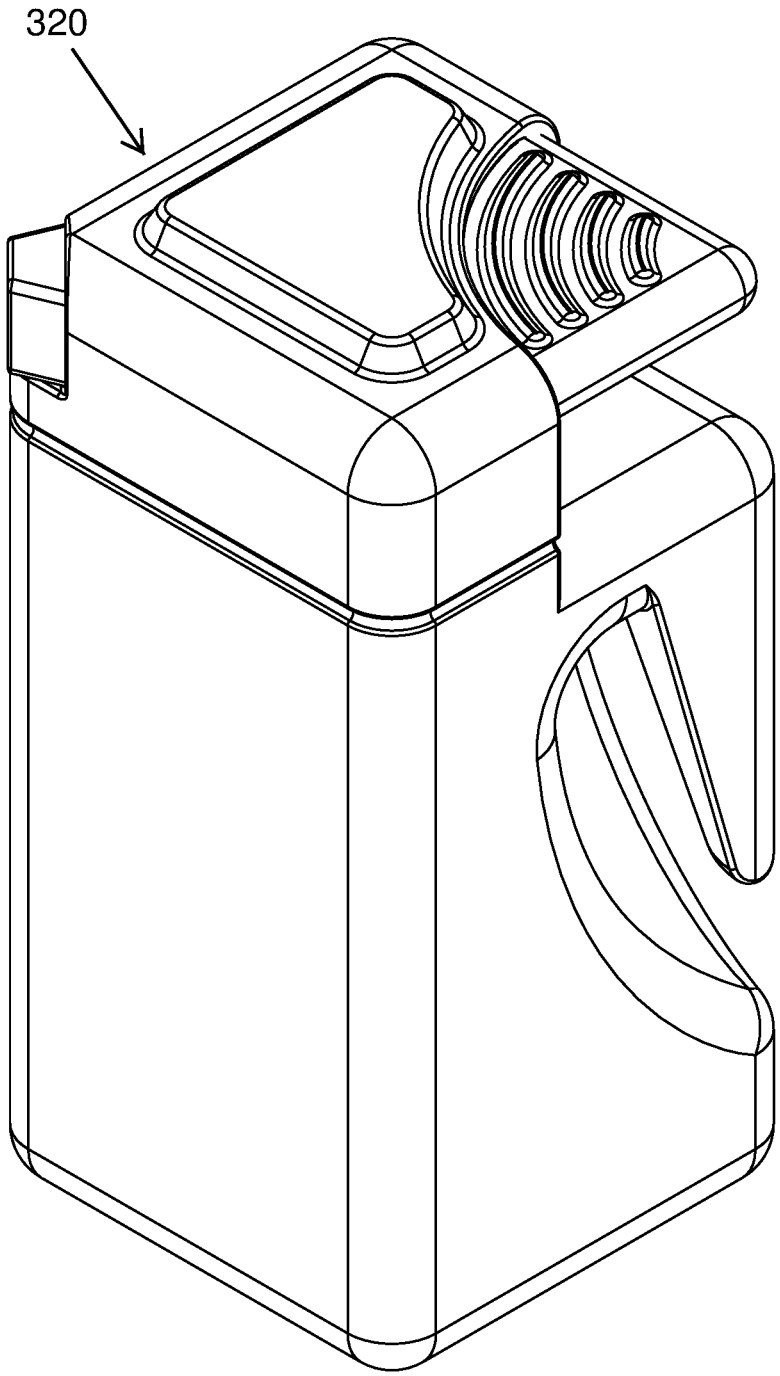
FIG. 15 is a perspective view of a stackable, spray bottle, in accordance with another non-limiting exemplary embodiment of the present disclosure.
Figure 16:
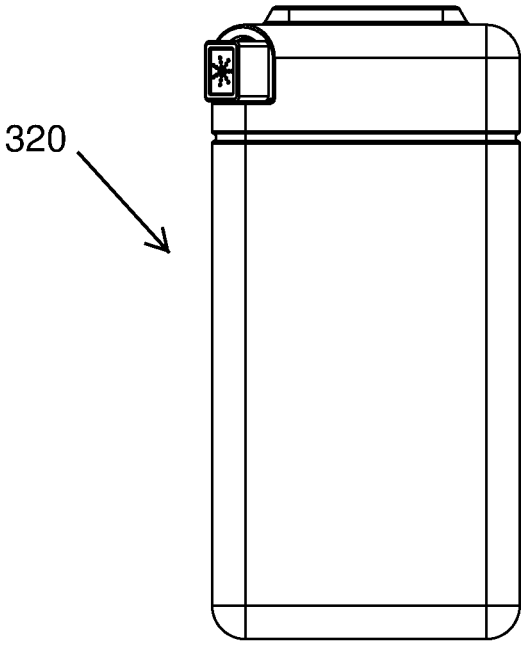
FIG. 16 is a front elevational view of the stackable, spray bottle shown in FIG. 15.
Figure 17:
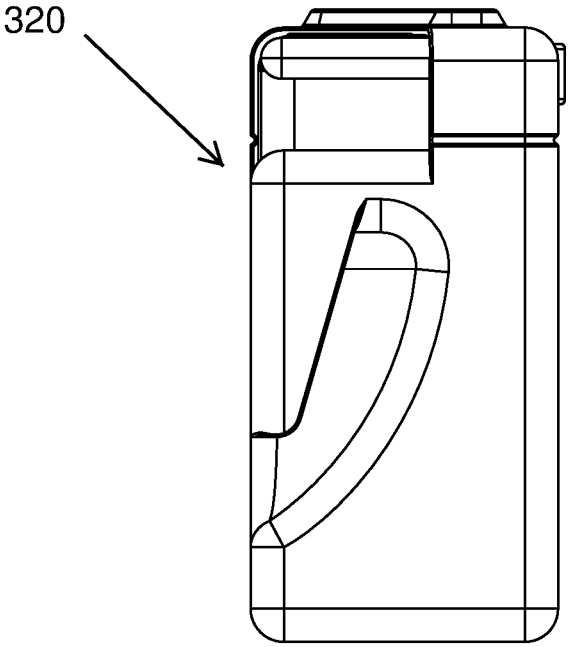
FIG. 17 is a side elevational view of the stackable, spray bottle shown in FIG. 15.
Figure 18:
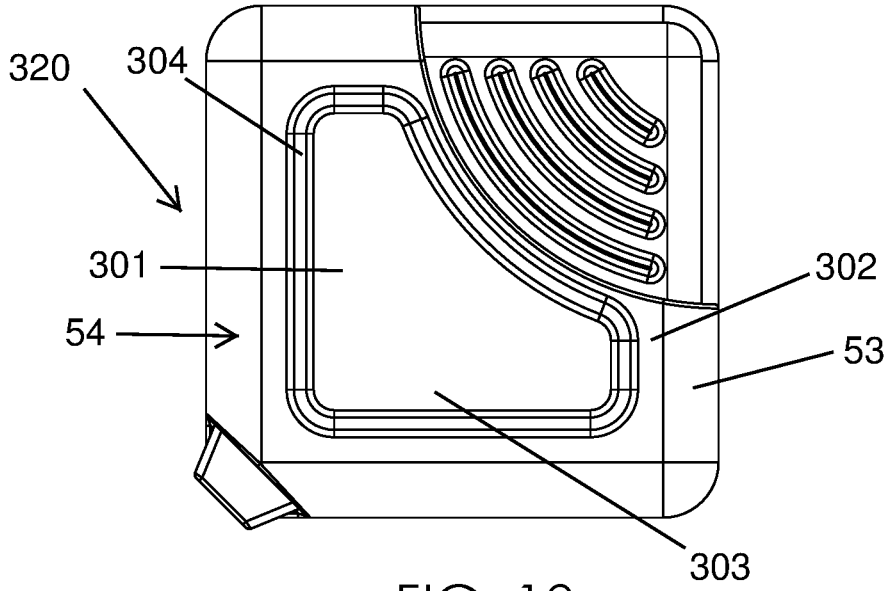
FIG. 18 is a top plan view of the view of stackable, spray bottle shown in FIG. 15.
Figure 19:
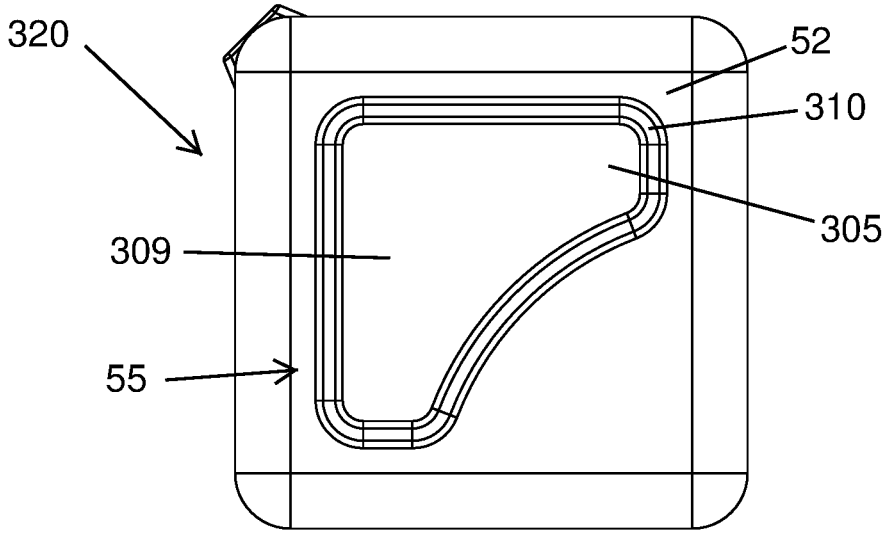
FIG. 19 is a bottom plan view of the view of stackable, spray bottle shown in FIG. 15.
Figure 20:
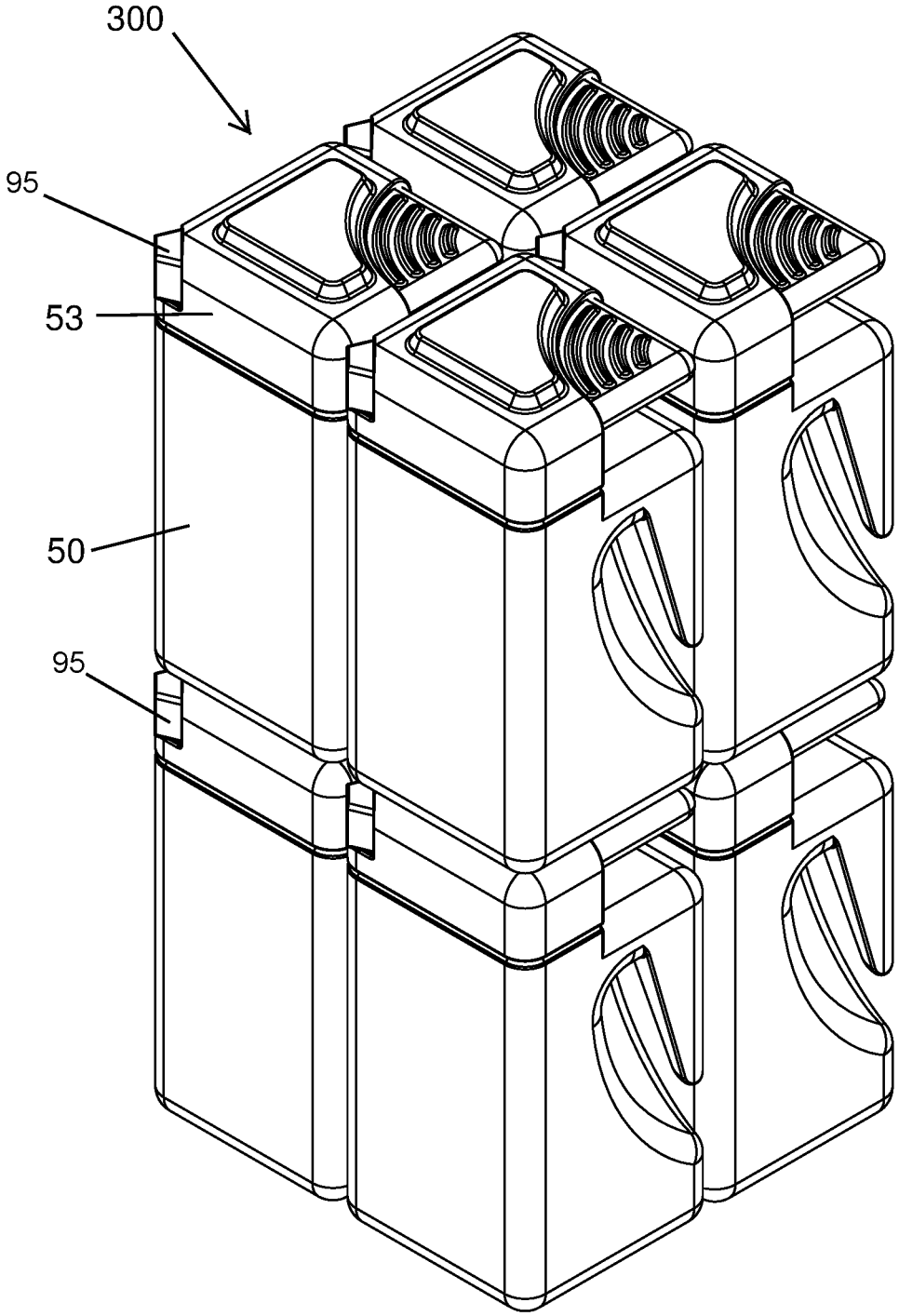
FIG. 20 is a perspective view of a group of stacked, spray bottles shown in FIG. 15.
Figure 21:
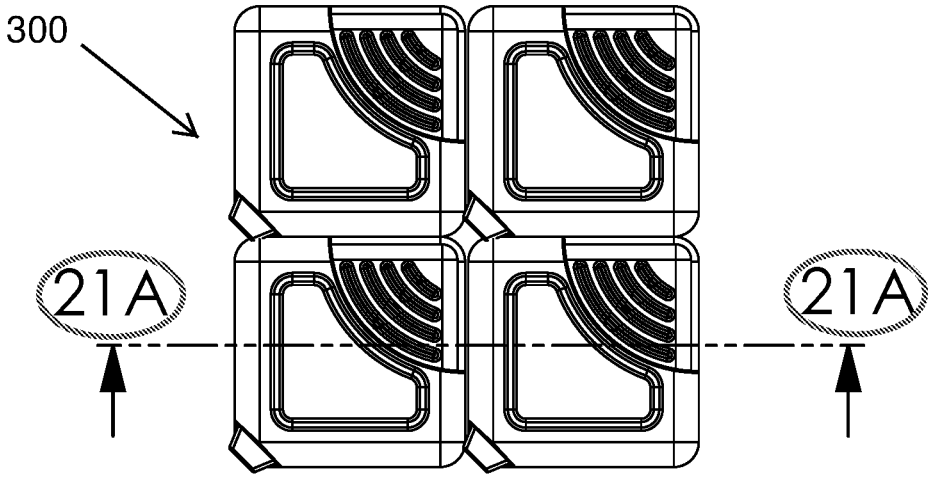
FIG. 21 is a top plan view of the group of stacked, spray bottles shown in FIG. 20.
Figure 22:
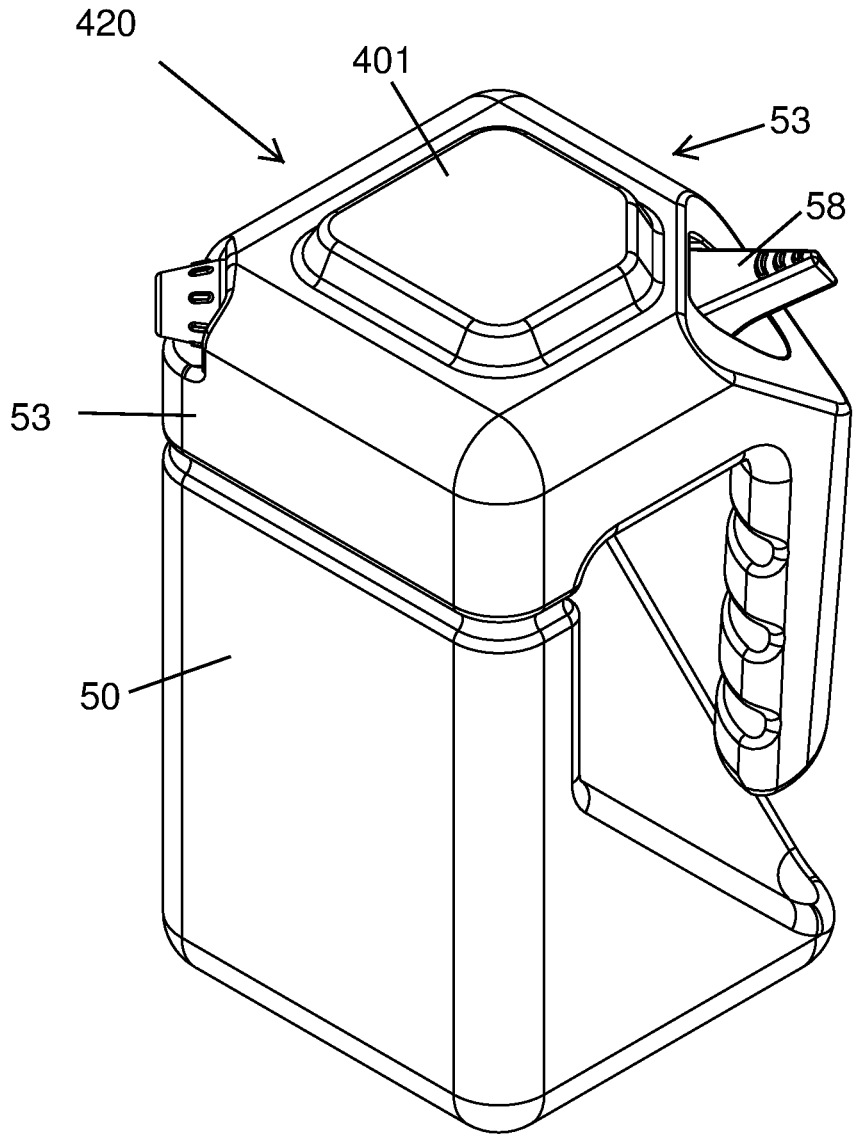
FIG. 22 is a perspective view of a stackable, spray bottle, in accordance with another non-limiting exemplary embodiment of the present disclosure.
Figure 23:
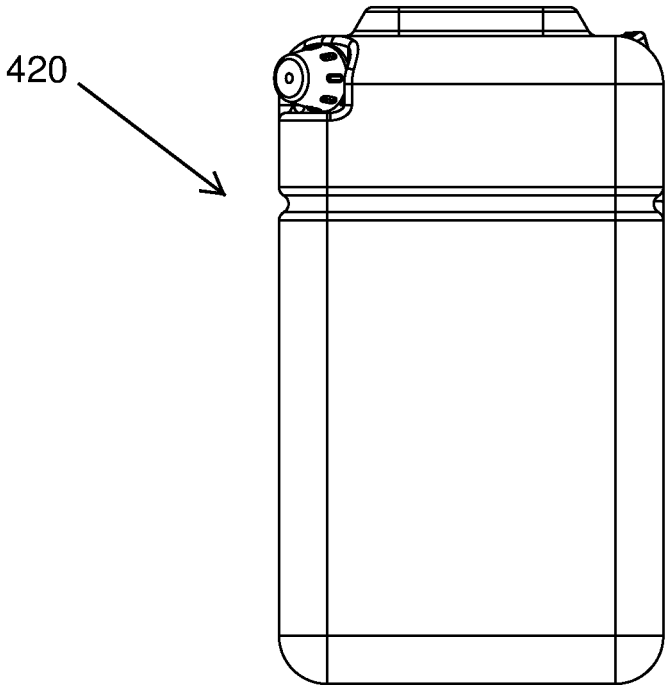
FIG. 23 is a front elevational view of the stackable, spray bottle shown in FIG. 22.
Figure 24:
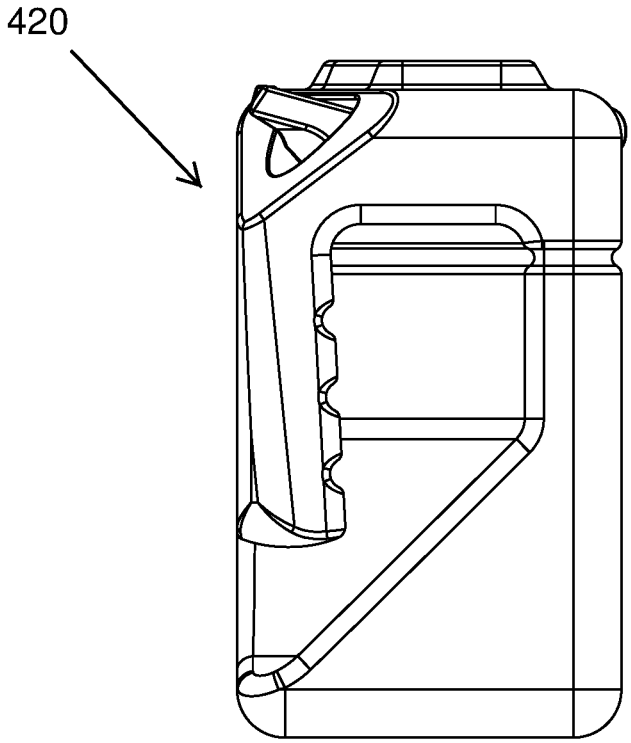
FIG. 24 is a side elevational view of the stackable, spray bottle shown in FIG. 22.
Figure 25:
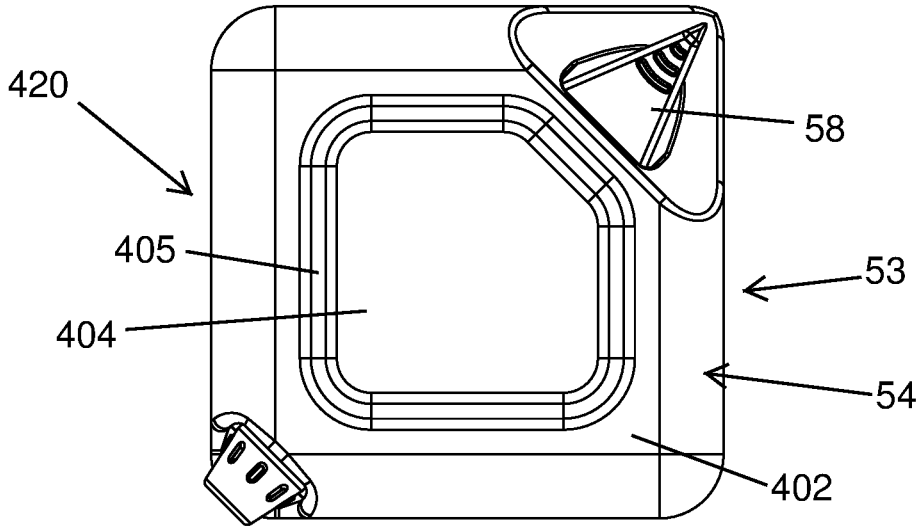
FIG. 25 is a top plan view of the view of stackable, spray bottle shown in FIG. 22.
Figure 26:
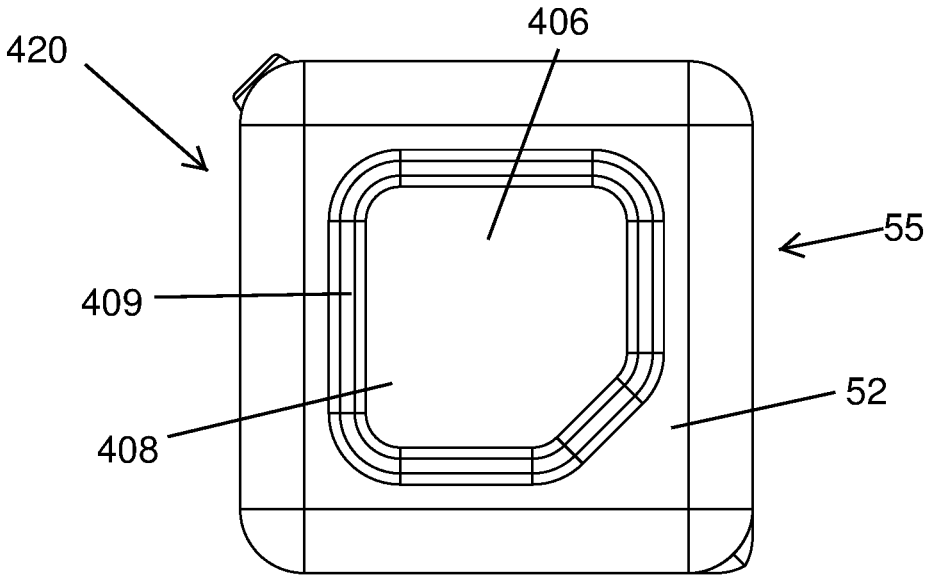
FIG. 26 is a bottom plan view of the view of stackable, spray bottle shown in FIG. 22.
Figure 27:
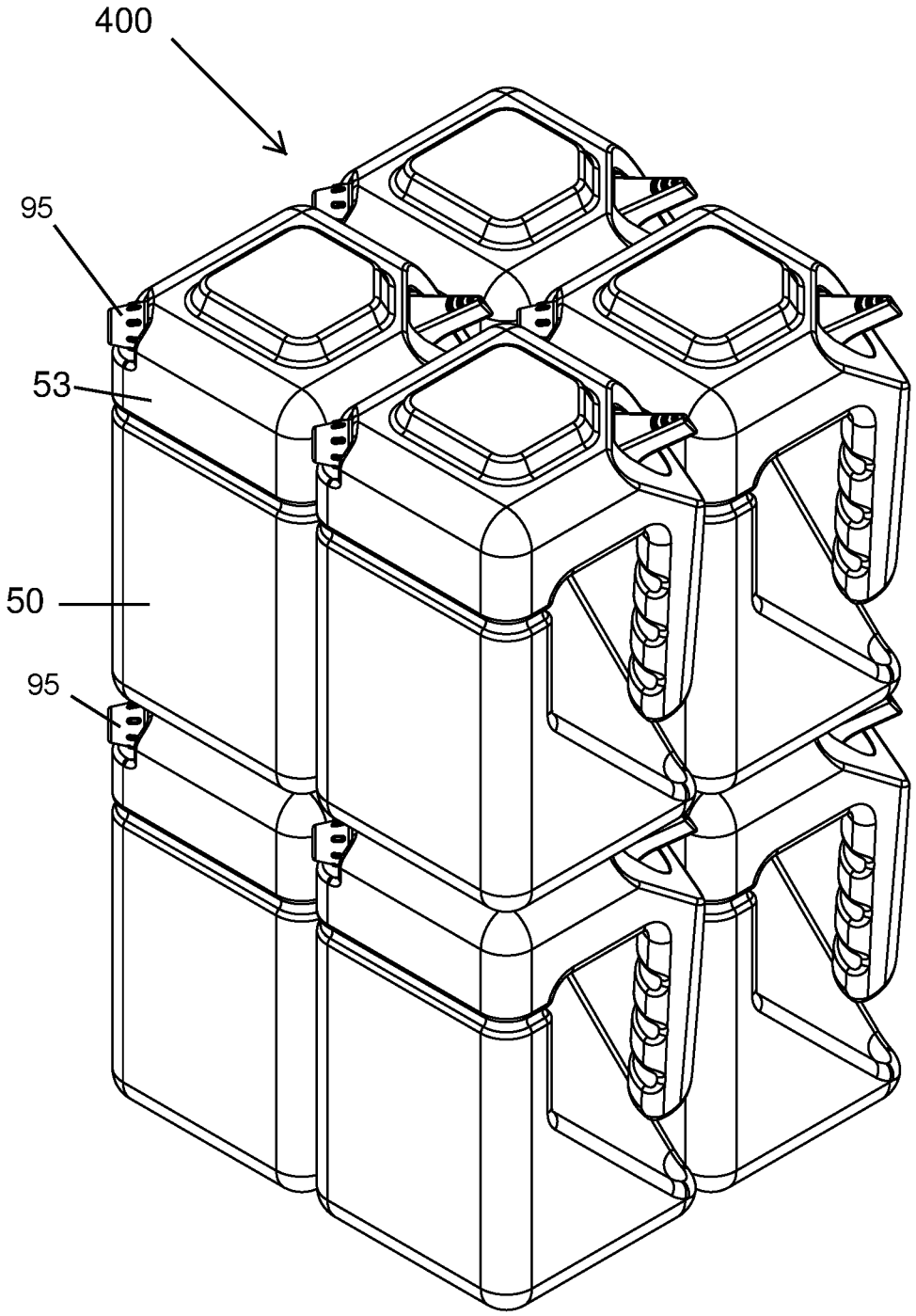
FIG. 27 is a perspective view of a group of stacked, spray bottles shown in FIG. 22.
Figure 28:
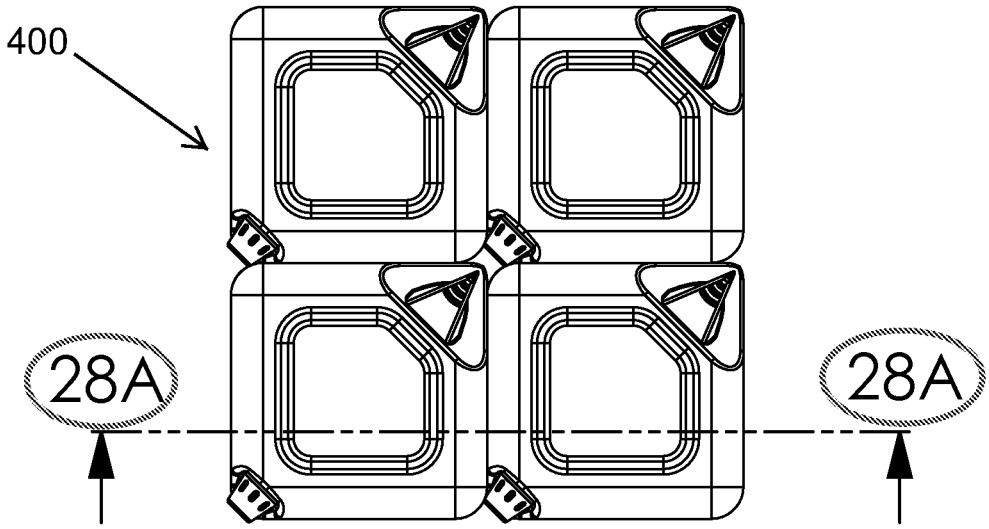
FIG. 28 is a top plan view of the group of stacked, spray bottles shown in FIG. 27.
Figure 29:
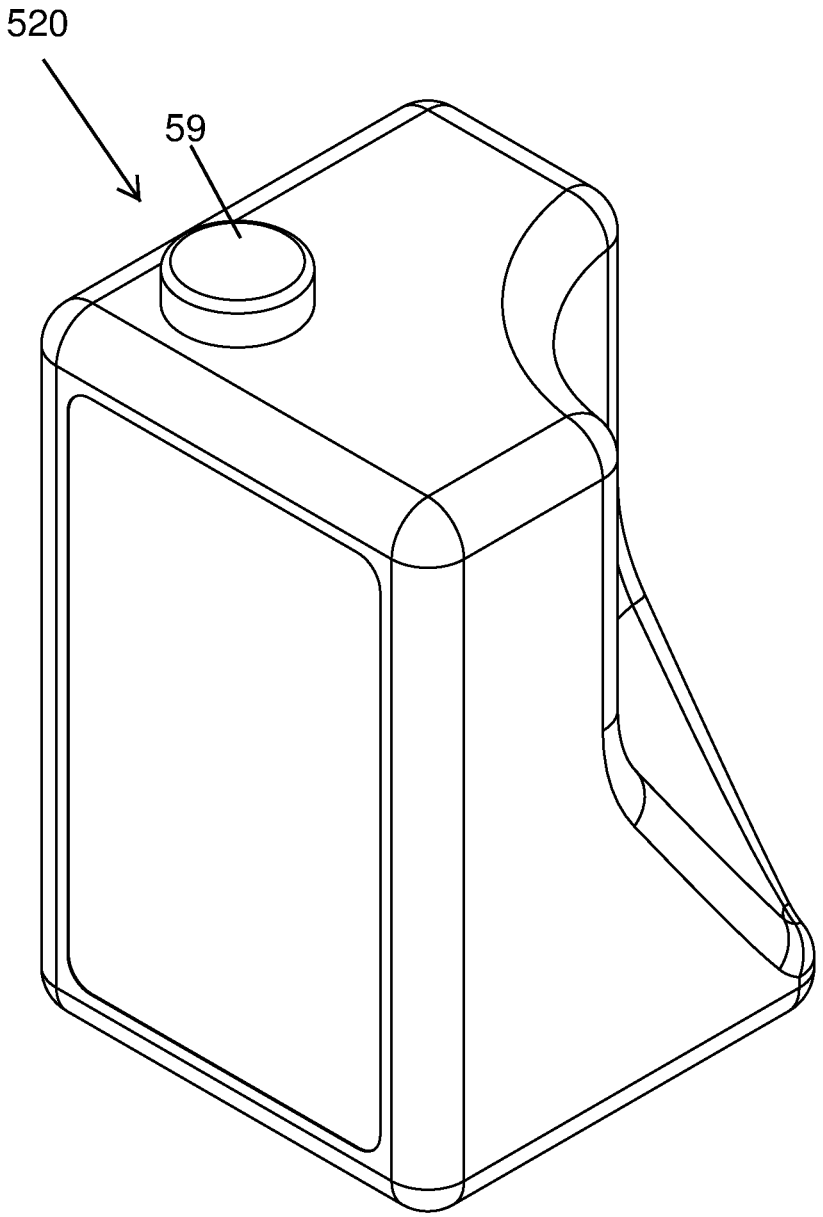
FIG. 29 is a perspective view of a stackable, spray bottle, in accordance with another non-limiting exemplary embodiment of the present disclosure.
Figure 30:
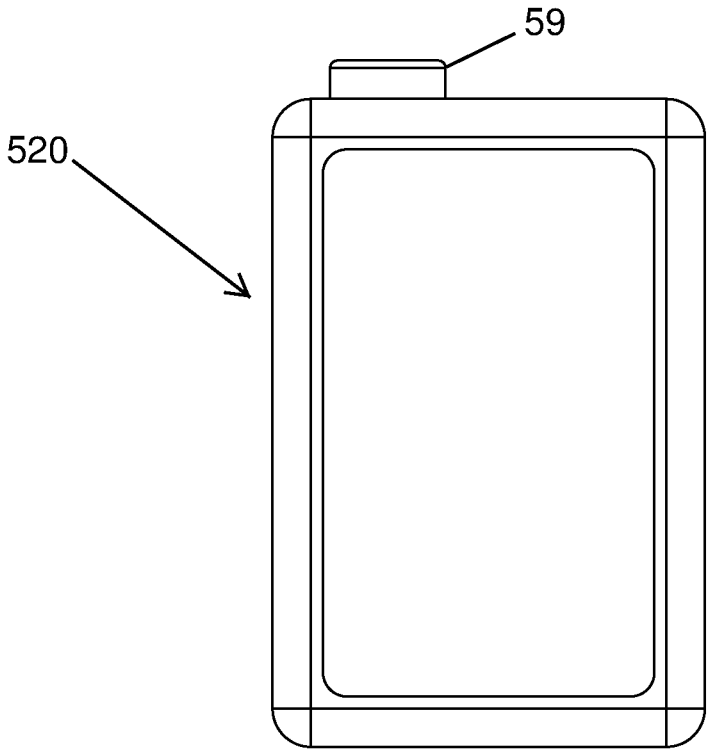
FIG. 30 is a front elevational view of the stackable, spray bottle shown in FIG. 29.
Figure 31:
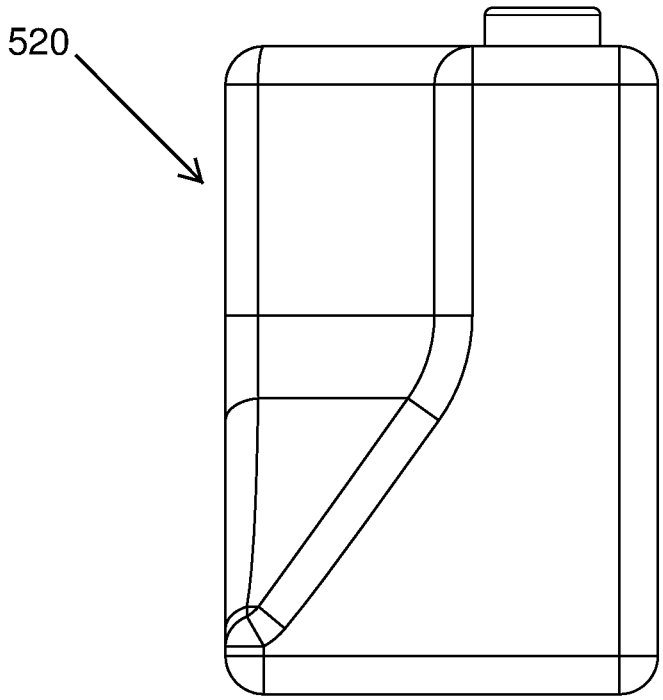
FIG. 31 is a side elevational view of the stackable, spray bottle shown in FIG. 29.
Figure 32:
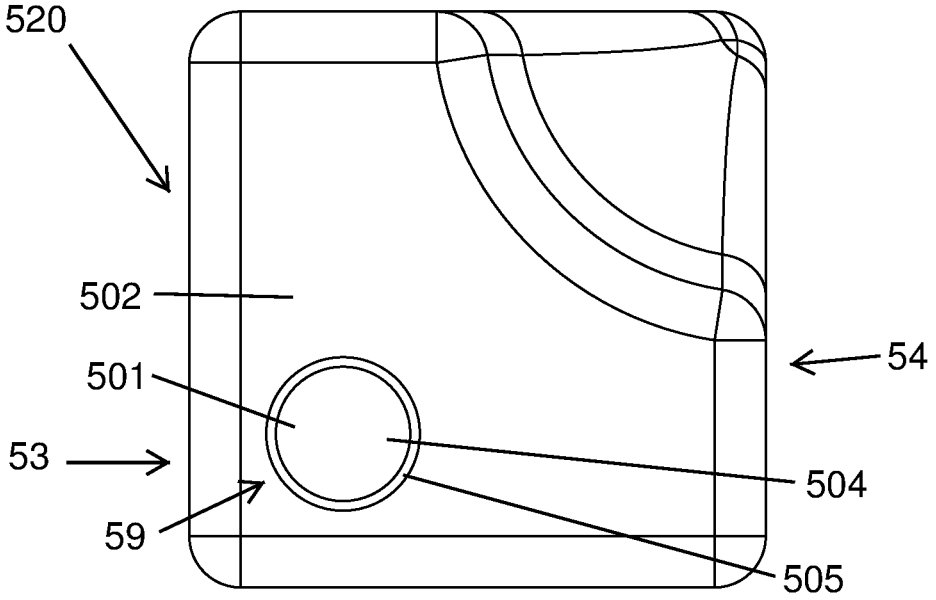
FIG. 32 is a top plan view of the view of stackable, spray bottle shown in FIG. 29.
Figure 33:
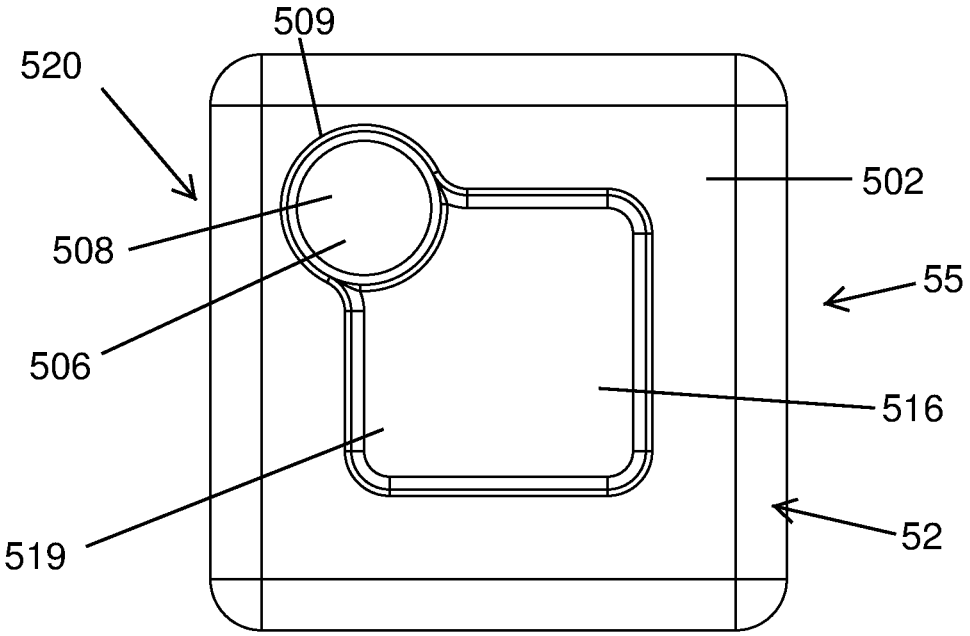
FIG. 33 is a bottom plan view of the view of stackable, spray bottle shown in FIG. 29.
Figure 34:
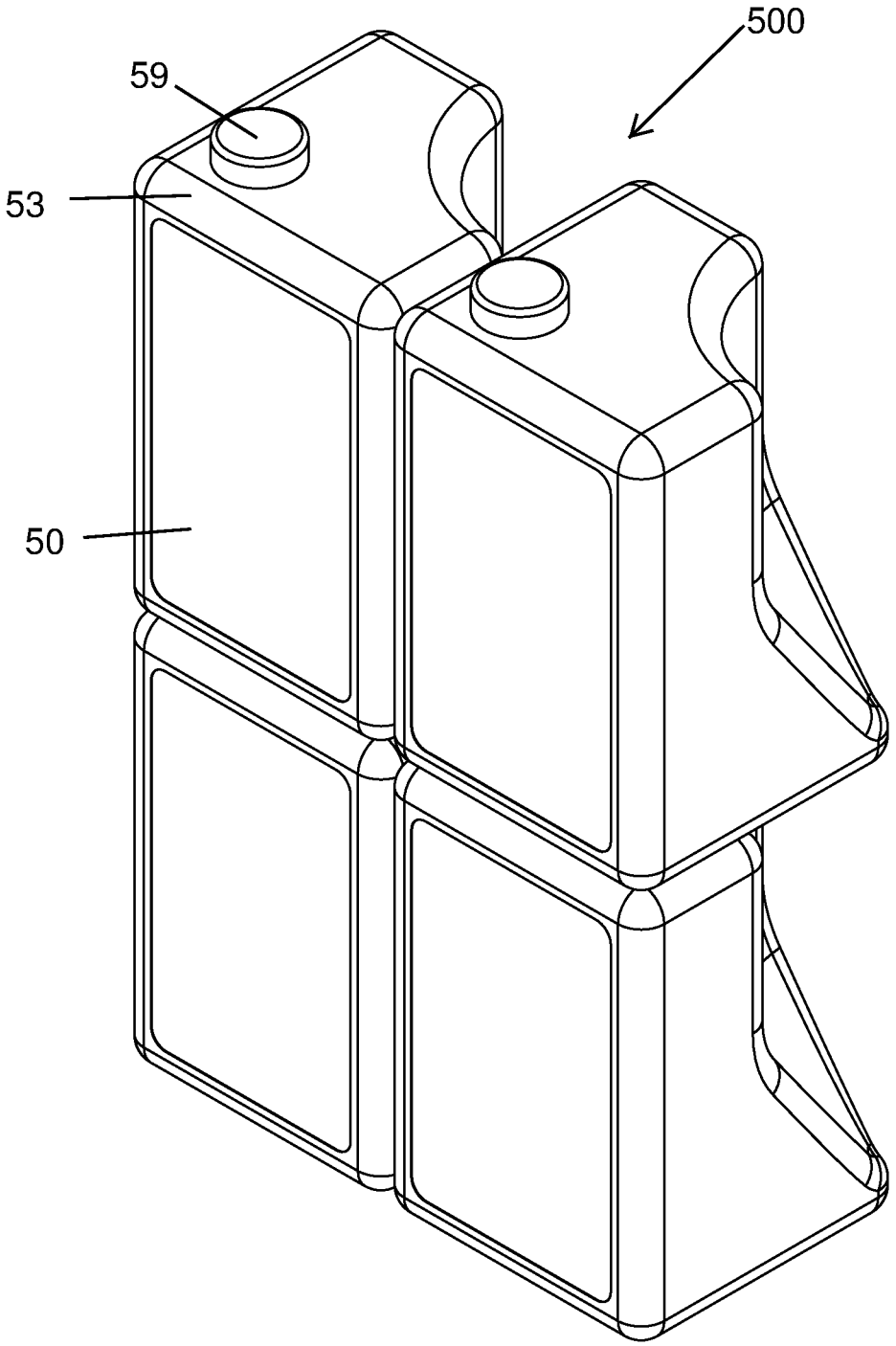
FIG. 34 is a perspective view of a group of stacked, spray bottles shown in FIG. 29.
Figure 35:
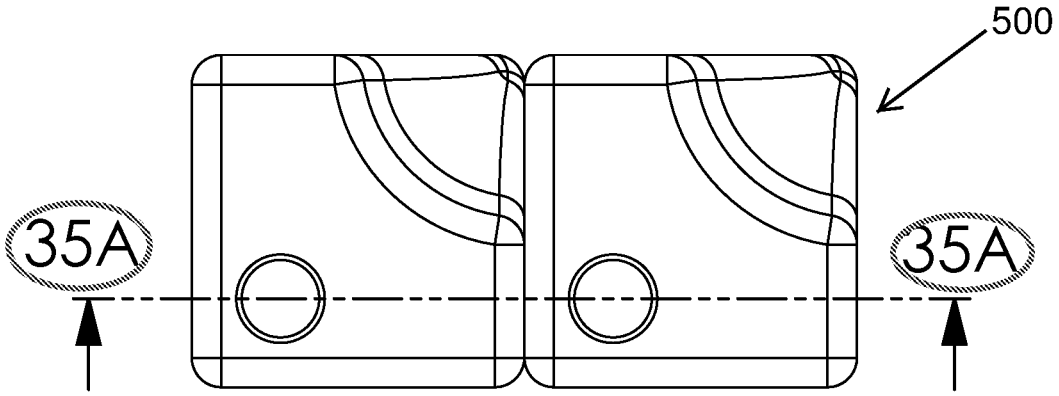
FIG. 35 is a top plan view of the group of stacked, spray bottles shown in FIG. 34.
Figure 35A:
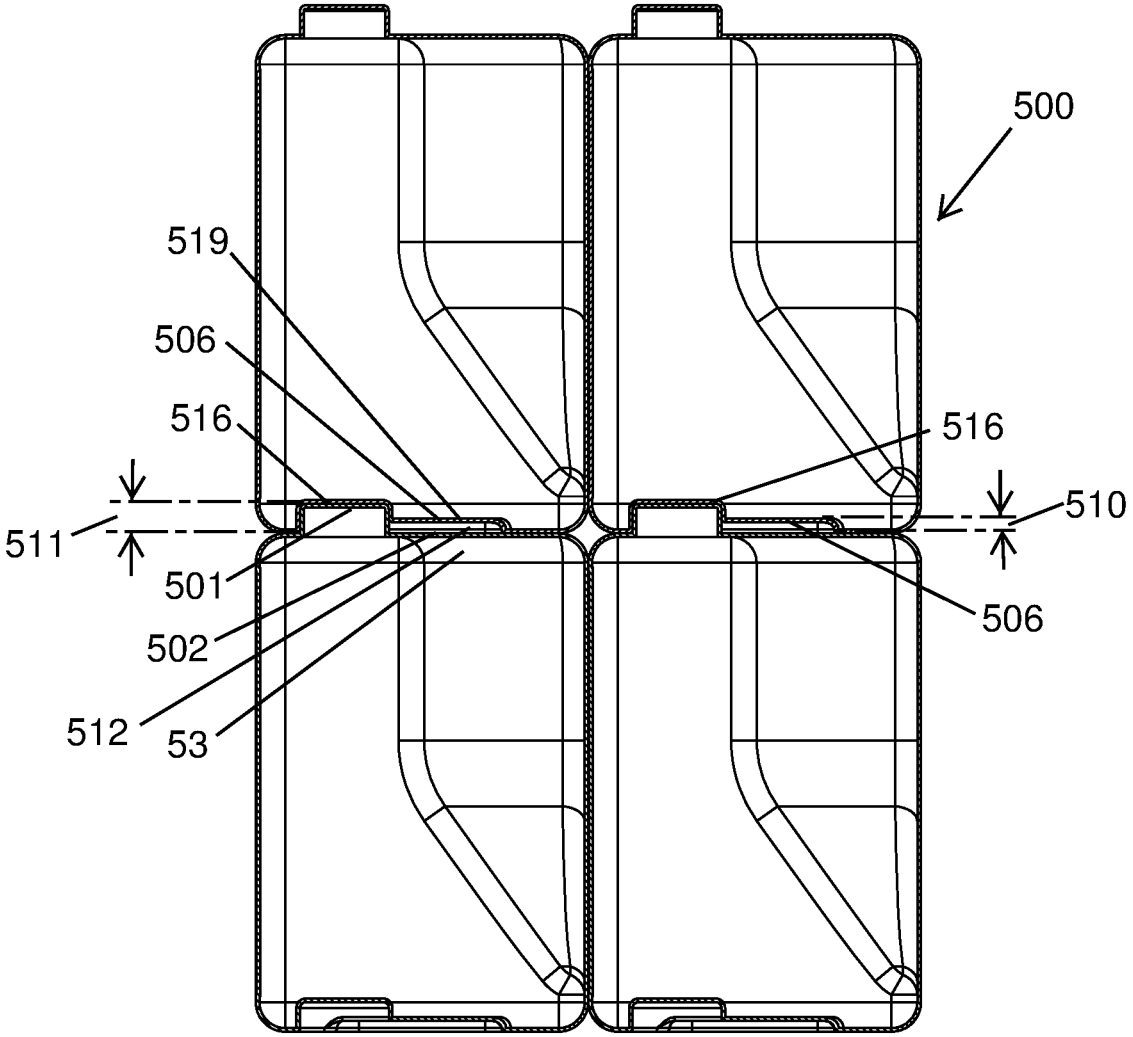
FIG. 35A is a cross-sectional view taken along line 35A-35A in FIG. 35.

Non-limiting exemplary embodiment(s) of the present disclosure are referred to generally FIGS. 1-35A and are intended to provide a handheld, stackable, liquid spray bottle 100, 200, 300, 400, 500 including a top portion containing a spray mechanism 57, 58 appropriately contoured to engage and mate with a bottom portion of another spray bottle stacked thereon. Additionally, replacement fluid-housing containers are suitably sized and shaped so that a bottom portion of a first replacement container stacks on a top portion of a second replacement container. The spray bottle may be operated manually, or it may be battery operated. It should be understood that the exemplary embodiment(s) may be used to house and discharge a variety of fluids and should not be limited to any particular fluid contained therein.

The non-limiting exemplary embodiment(s) is/are referred to generally in FIGS. 1-35A and is/are intended to provide a stackable spray bottle assembly for being vertically stacked during storage. Five non-limiting exemplary embodiments are illustrated in FIGS. 1-35A. The embodiments are identified by reference numerals 100, 200, 300, 400, 500. Such a stackable spray bottle assembly includes a top stackable spray bottle and an identical bottom stackable spray bottle detachably engaged therewith (collectively referred to at 120, 220, 320, 420, 520). Each of the top stackable spray bottle and the bottom stackable spray bottle include a reservoir 50 having an open top portion 51 (when accessory 53 is removed therefrom)d and a closed bottom portion 52, and an accessory 53 removably coupled to the open top portion 51. Advantageously, the accessory 53 has a first silhouette 54, and the bottom portion 52 has a second silhouette 55 conforming to the first silhouette 54 such that, during storage, the top stackable spray bottle is maintained at a substantially stable position when stacked on top of the bottom stackable spray bottle. Notably, the reservoir 50 has an interior volume greater than an interior volume of the accessory 53. The terms silhouette means the profile or outer contour of each spray bottle 120, 220, 320, 420, 520.

In a non-limiting exemplary embodiment, the accessory 53 includes one of a power-actuated trigger mechanism 57 and a manually-actuated trigger mechanism 58.

In a non-limiting exemplary embodiment, the accessory 53 includes an end cap 59 having the first silhouette 54.

As shown in the various embodiments of FIGS. 1-35A a variety of silhouettes 54, 55 may be employed, which support the spray bottles 120, 220, 320, 420, 520 at a balanced, stacked orientation.

Figure 7A:
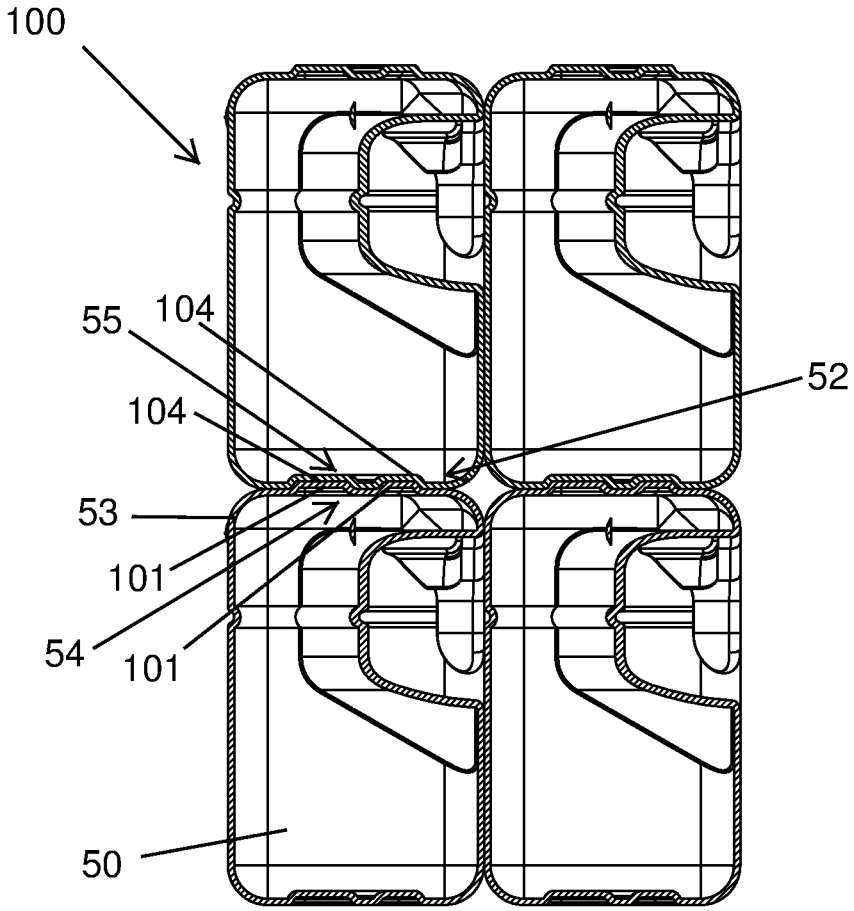
FIG. 7A is a cross-sectional view taken along line 7A-7A in FIG. 7.

Referring to FIGS. 1-7A, in a non-limiting exemplary embodiment 100, the first silhouette 54 of the bottom stackable spray bottle 120 includes a plurality of triangular protrusions 101 extended upwardly away from the accessory 53. Such triangular protrusions 101 are spaced apart and have a planar top surface 102 and a contoured outer perimeter edge 103 beginning at the accessory 53 and terminated at the planar top surface 102. Advantageously, the second silhouette 55 of the top stackable spray bottle 120 includes a plurality of triangular depressions 104 extended upwardly towards the first silhouette 54. Such triangular depressions 104 are spaced apart and have a planar bottom surface 105 and a contoured outer perimeter edge 103 beginning at the bottom portion 52 and terminated at the planar bottom surface 105. In this manner, during storage, each of the triangular depressions 104 of the top stackable spray bottle 120 are removably nested directly on the triangular protrusions 101 of the bottom stackable spray bottle 120, respectively.

Still referring to FIGS. 1-7A, in a non-limiting exemplary embodiment, a complete spray bottle 120 includes a grip 121 integrated into the spray head mechanism 57 that contains the protected spray trigger 124 in the handle 125. The spray trigger 124 could also operate as a thumb trigger on top of the spray head. It is noted that a variety of spray head mechanisms 57, 58 may be employed without departing from the true spirit and scope of the present disclosure. For example, due to the flat shape of the spray head, a battery powered spray mechanism could be integrated into the design for dispensing the liquid. Advantageously, the contour of the spray nozzle head is removably mated (engaged) to the spray bottle bottom (reservoir 50), which allows for efficient vertical stacking of the spray bottles. In particular, a silhouette 54, 55 of each spray bottle bottom portion 52 is suitably sized and shaped to contiguously receive thereon a corresponding silhouette of accessory 53. Such a structural configuration maintains each stacked spray bottle 120 at a substantially stable position during non-use/transport while taking up less space in spaced-confined environments.

Figure 14A:
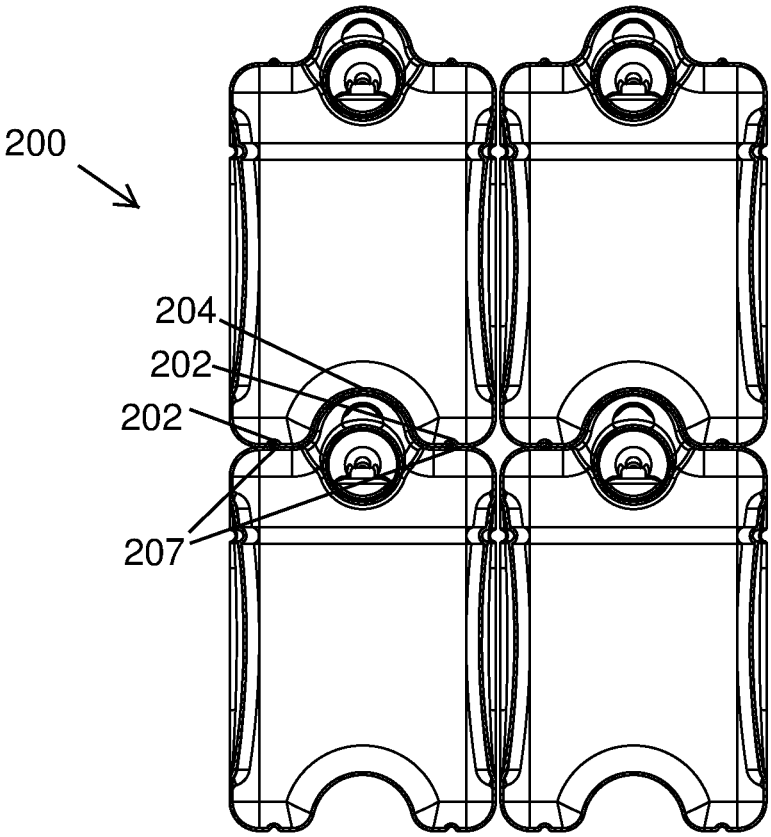
FIG. 14A is a cross-sectional view taken along line 14A-14A in FIG. 14.

Referring to FIGS. 8-14A, in a non-limiting exemplary embodiment 200, the first silhouette 54 of the bottom stackable spray bottle 220 includes a plurality of rectilinear protrusions 201 extended upwardly away from the accessory 53. Such rectilinear protrusions 201 are spaced apart and registered parallel to each other wherein each of the rectilinear protrusions 201 has an arcuate top surface 202 extended along an entire longitudinal length thereof. A handle 203 having a dome-shaped top face 204 is intermediately positioned between the rectilinear protrusions 201 and extended parallel to the rectilinear protrusions 201. Advantageously, the second silhouette 55 of the top stackable spray bottle 220 includes a plurality of rectilinear depressions 205 extended upwardly away from the accessory 53. Such rectilinear depressions 205 are spaced apart and registered parallel to each other. Notably, each the rectilinear depression 205 has an arcuate top surface 207 extended along an entire longitudinal length thereof. A dome-shaped handle-receiving channel 208 is intermediately positioned between the rectilinear depressions 205 and extended parallel to the rectilinear depressions 205. In this manner, during storage, each of the rectilinear depressions 205 and the dome-shaped handle-receiving channel 208 of the top stackable spray bottle 220 are removably nested directly on the rectilinear protrusions 201 and the handle 203 of the bottom stackable spray bottle 220, respectively.

Still referring to FIGS. 8-14A, in a non-limiting exemplary embodiment, spray bottle 220 includes horizontal handle 203 mounted in the middle of the spray trigger 57. Such a spray trigger 57 is mounted underneath the handle 203 so that it is protected from accidental drops. The spray trigger 57 could also operate as a thumb trigger mounted on top of the handle 203. Due to the shape of the accessory 53, a battery powered spray mechanism could be integrated in to the design for dispensing the liquid. The contour of the spray nozzle head is removably mated (engaged) to the spray bottle bottom (reservoir 50), which allows for efficient stacking of the spray bottles 220. In particular, the silhouettes 54, 55 includes a dome-shaped central region 204 with a pair of opposed bulbous protrusions 201 equidistantly spaced from opposed sides of the dome-shaped central region 204.

Figure 21A:
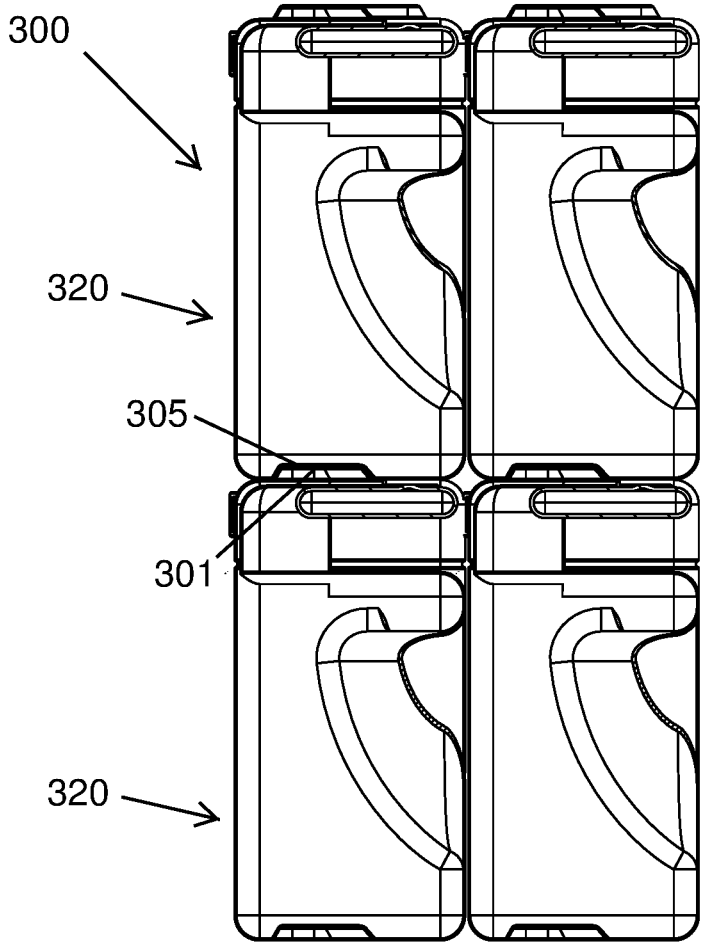
FIG. 21A is a cross-sectional view taken along line 21A-21A in FIG. 21.

Referring to FIGS. 15-21A, in a non-limiting exemplary embodiment 300, the first silhouette 54 of the bottom stackable spray bottle 320 includes a boomerang-shaped protrusion 301 extended upwardly away from the accessory 53 thereof. Such a boomerang-shaped protrusion 301 covers a major surface area of a top surface 302 of the accessory 53. Notably, the boomerang-shaped protrusion 301 has a planar top surface 303 and a contoured outer perimeter edge 304 beginning at the accessory 53 and terminated at the planar top surface 303. Advantageously, the second silhouette 55 of the top stackable spray bottle 320 includes a boomerang-shaped depression 305 extended upwardly towards the accessory 53 thereof. Such a boomerang-shaped depression 305 covers a major surface area of the bottom portion 52. Notably, the boomerang-shaped depression 305 has a planar bottom surface 309 and a contoured outer perimeter edge 310 beginning at the bottom portion 52 and terminated at the planar bottom surface 309. Advantageously, during storage, the boomerang-shaped depression 305 of the top stackable spray bottle 320 is removably nested directly on the boomerang-shaped protrusion 301 of the bottom stackable spray bottle 320, respectively.

Still referring to FIGS. 15-21A, the complete spray bottle 320 includes a handle 330 integrated (monolithically formed) with the spray bottle accessory 53. A thumb operated spray trigger 58 is mounted on top of the spray head. Due to the shape of the accessory 53, a battery powered spray mechanism could be integrated into the design for dispensing the liquid. A silhouette 55 of the accessory 53 is mated to the spray bottle bottom second silhouette 54, which allows for efficient stacking of the spray bottles 320.

Figure 28A:
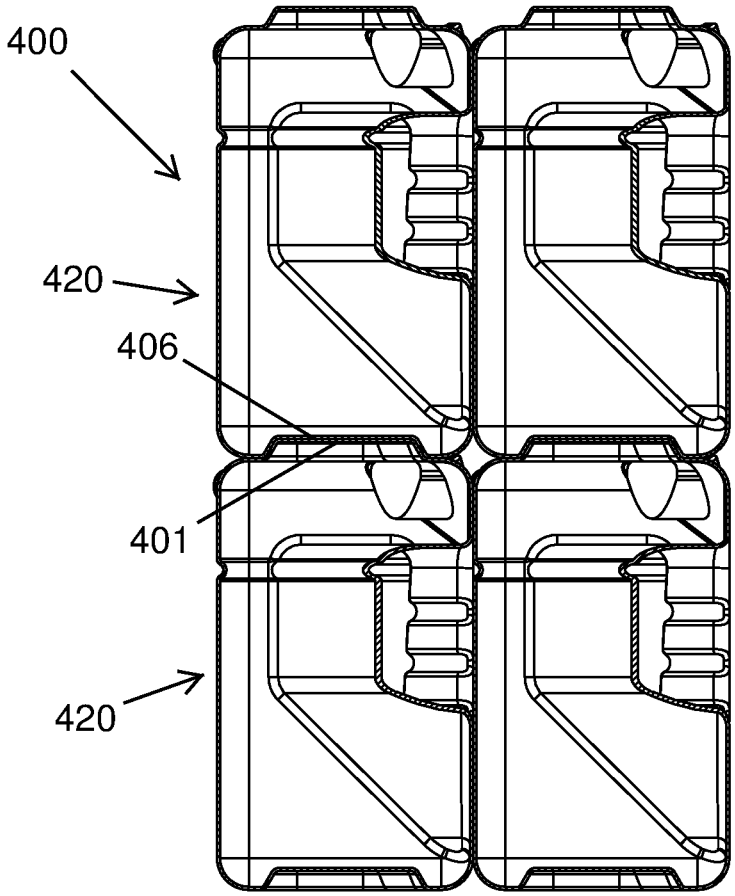
FIG. 28A is a cross-sectional view taken along line 28A-28A in FIG. 28.

Referring to FIGS. 22-28A, in a non-limiting exemplary embodiment 400, the first silhouette 54 of the bottom stackable spray bottle 420 includes a generally square-shaped protrusion 401 extended upwardly away from the accessory 53 thereof. Such a generally square-shaped protrusion 401 covering a major surface area of a top surface 402 of the accessory 53, and the generally square-shaped protrusion 401 has a planar top surface 404 and a contoured outer perimeter edge 405 beginning at the accessory 53 and terminated at the planar top surface 404. Advantageously, the second silhouette 55 of the top stackable spray bottle includes a generally square-shaped depression 406 extended upwardly towards the accessory 53 thereof. Such a generally square-shaped depression 406 covers a major surface area of the bottom portion 52. Notably, the generally square-shaped depression 406 has a planar bottom surface 408 and a contoured outer perimeter edge 409 beginning at the bottom portion 52 and terminated at the planar bottom surface 408. Advantageously, during storage, the generally square-shaped depression 406 of the top stackable spray bottle 420 is removably nested directly on the generally square-shaped protrusion 401 of the bottom stackable spray bottle 420, respectively.

Another non-limiting exemplary embodiment is illustrated wherein the complete spray bottle includes selected structural features from the embodiments shown in FIGS. 1-7A and 15-21A. In particular, the thumb operated spray trigger is located on top of the spray head. Such a spray trigger could also be finger-operated and located underneath the handle as shown FIGS. 1-7A. Due to the shape of the accessory 53, a battery powered spray mechanism could be integrated therein for dispensing the liquid. The conforming and complimentary silhouettes 54, 55 provide efficient stacking of the spray bottles.

Referring to FIGS. 29-35A, in a non-limiting exemplary embodiment 500, the first silhouette 54 of the end cap 59 of the bottom stackable spray bottle 520 has a circular-shaped protrusion 501 extended upwardly away from the accessory 53 thereof. Such a circular-shaped protrusion 501 covers a minor surface area of a top surface 502 of the accessory 53. Notably, the circular-shaped protrusion 501 has a planar top surface 504 and an annular circumferential edge 505 terminated at the planar top surface 504. Advantageously, the second silhouette 55 of the top stackable spray bottle 520 includes a circular-shaped depression 506 extended upwardly towards the accessory 53 thereof. Such circular-shaped depression 506 covers a minor surface area of the bottom portion 52. Notably, the circular-shaped depression 506 has a planar bottom surface 508 and an annular circumferential edge 509 terminated at the planar bottom surface 508, and a substantially square-shaped depression 516 contiguously positioned with the circular-shaped depression 506. In this manner, the substantially square-shaped depression 516 and the circular-shaped depression 506 cover a major surface area of the bottom portion 52. Notably, the substantially square-shaped depression 516 has a height 510 that is lesser than a height 511 of the circular-shaped depression 506. Advantageously, during storage, the circular-shaped depression 506 of the top stackable spray bottle 520 is removably nested directly on the circular-shaped protrusion 501 of the bottom stackable spray bottle 520, respectively, such that a gap 512 is formed between the top surface 502 of the accessory 53 and the planar bottom surface 519 of the substantially square-shaped depression 506.

Still referring to FIGS. 29-35A, the spray bottle 520 is depicted as a refill pod. The bottom portion 52 of each refill pod is contoured and has a recess so that it can stack on top of another similarly designed refill pod having complimentary silhouettes 54, 55. The refill pods do not have spray trigger mechanisms. Refill pods are not shown for the other embodiments described hereinabove, although they would be similarly designed as those shown for the present embodiment.

Referring to FIGS. 1-35A in general, functionally, the preferred embodiments of the present disclosure are not gripped. Rather than gripping the spray bottle body, the user will hold a handle that is integrated into the spray head, and then manually activate a trigger mechanism 57, 58 with a thumb, a finger, multiple fingers, or any combination of these. The design may also feature a battery powered option activated by a button or other mechanism for dispensing chemical versus the traditional finger trigger. As noted hereinabove, a variety of trigger mechanisms may be employed without departing from the true spirit and scope of the present disclosure.

When purchased for the first time, the entire spray bottle will include the accessory 53 and reservoir 50. Once the liquid in the spray bottle has been depleted, the user can remove the existing accessory 53 and refill with chemical by pouring liquid in to the original container, or the user can simply replace the reservoir 50 with a similarly designed refill pod. The terms "reservoir" and "spray bottle body" are interchangeably used throughout this disclosure. The terms "accessory" and "spray bottle head" are interchangeably used throughout this disclosure.

The reservoir 50 preferably attaches to the accessory 53 in any number of fashions including but not limited to twist on, screw on, snap on, or slide on. The spray bottle may also include a manner for hanging the entire mechanism on a belt loop, pocket, shelf, cart, etc. The accessory 53 has a dispensing tip 95 disposed at an outer perimeter of the reservoir 50 as well as subjacent to a topmost surface of the reservoir 50 such that the dispensing tip 95 is exposed and operable when the top stackable spray bottle 120, 220, 320, 420, 520 is stacked on top of the bottom stackable spray bottle 120, 220, 320, 420, 520. The dispensing tip 95 is laterally spaced apart from the first silhouette 54 and the second silhouette 55.

The multiple benefits of the present disclosure include, but are not limited to, the following: 1. Stackability of the entire spray mechanism where individual bottles can be stacked one on top of each other. 2. Stackability of the spray bottle body so that replacement cartridges (aka refills) can be stacked one on top of each other. 3. A shorter overall profile that results in a reduction of bottle height. 4. Reduced waste and cost because the spray mechanism will be reused while the fluid container will be replaced with refills pods. 5. Improved durability due to the protected spray mechanism. 6. The ability to add a battery powered option for dispensing chemical. 7. A unique design that is differentiated from existing spray bottles.

The benefits to manufacturers include a shorter profile that requires less shelf height when displayed on retailer shelves, more efficient shipping configurations from the factory, a eco-friendlier design that reduces waste, and a new, innovative design that will pique the interest of consumers.

Consumer benefits include stackability of the multiple spray units, stackability of multiple refill pods, more efficient use of shelf/cabinet space, reduced waste and cost because only the fluid container needs to be replaced while the spray mechanism will be reused, an ergonomic, robust design that will last longer than existing spray bottles due to the protected spray mechanism, and a new, exciting design that is more attuned to similar types of houseware innovations.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A stackable spray bottle assembly for being vertically stacked during storage, said stackable spray bottle assembly comprising:

a top stackable spray bottle and a bottom stackable spray bottle detachably engaged therewith, each of said top stackable spray bottle and said bottom stackable spray bottle including a reservoir having an open top portion and a closed bottom portion, and an accessory removably coupled to said open top portion;

wherein said accessory has a first silhouette;

wherein, during storage, said bottom portion has a second silhouette conforming to said first silhouette such that said top stackable spray bottle is maintained at a substantially stable position when stacked on top of said bottom stackable spray bottle;

wherein said accessory has a dispensing tip disposed at an outer perimeter of said reservoir as well as subjacent to a topmost surface of said reservoir such that said dispensing tip is exposed and operable when said top stackable spray bottle is stacked on top of said bottom stackable spray bottle.

2. The stackable spray bottle assembly of claim 1, wherein said accessory comprises: one of a power-actuated trigger mechanism and a manually-actuated trigger mechanism.

3. The stackable spray bottle assembly of claim 2, wherein said first silhouette of said bottom stackable spray bottle comprises:

a plurality of rectilinear protrusions extended upwardly away from said accessory, said rectilinear protrusions being spaced apart and registered parallel to each other, each said rectilinear protrusions having an arcuate top surface extended along an entire longitudinal length thereof; and a handle having a dome-shaped top face intermediately positioned between said rectilinear protrusions and extended parallel to said rectilinear protrusions;

wherein said second silhouette of said top stackable spray bottle comprises: a plurality of rectilinear depressions extended upwardly away from said accessory, said rectilinear depressions being spaced apart and registered parallel to each other, each said rectilinear depressions having an arcuate top surface extended along an entire longitudinal length thereof; and a dome-shaped handle-receiving channel intermediately positioned between said rectilinear depressions and extended parallel to said rectilinear depressions;

wherein, during storage, each of said rectilinear depressions and said dome-shaped handle-receiving channel of said top stackable spray bottle are removably nested directly on said rectilinear protrusions and said handle of said bottom stackable spray bottle, respectively.

4. The stackable spray bottle assembly of claim 2, wherein said first silhouette of said bottom stackable spray bottle comprises: a boomerang-shaped protrusion extended upwardly away from said accessory thereof, said boomerang-shaped protrusion covered a major surface area of a top surface of said accessory, said boomerang-shaped protrusion having a planar top surface and a contoured outer perimeter edge beginning at said accessory and terminated at said planar top surface;

wherein said second silhouette of said top stackable spray bottle comprises: a boomerang-shaped depression extended upwardly towards said accessory thereof, said boomerang-shaped depression covering a major surface area of said bottom portion, said boomerang-shaped depression having a planar bottom surface and a contoured outer perimeter edge beginning at said bottom portion and terminated at said planar bottom surface;

wherein, during storage, said boomerang-shaped depression of said top stackable spray bottle is removably nested directly on said boomerang-shaped protrusion of said bottom stackable spray bottle, respectively.

5. The stackable spray bottle assembly of claim 2; wherein said first silhouette of said bottom stackable spray bottle comprises: a generally square-shaped protrusion extended upwardly away from said accessory thereof, said generally square-shaped protrusion covering a major surface area of a top surface of said accessory, said generally square-shaped protrusion having a planar top surface and a contoured outer perimeter edge beginning at said accessory and terminated at said planar top surface;

wherein said second silhouette of said top stackable spray bottle comprises: a generally square-shaped depression extended upwardly towards said accessory thereof, said generally square-shaped depression covering a major surface area of said bottom portion, said generally square-shaped depression having a planar bottom surface and a contoured outer perimeter edge beginning at said bottom portion and terminated at said planar bottom surface;

wherein, during storage, said generally square-shaped depression of said top stackable spray bottle is removably nested directly on said generally square-shaped protrusion of said bottom stackable spray bottle, respectively.

6. The stackable spray bottle assembly of claim 1, wherein said first silhouette of said bottom stackable spray bottle comprises: a plurality of triangular protrusions extended upwardly away from said accessory, said triangular protrusions being spaced apart and having a planar top surface and a contoured outer perimeter edge beginning at said accessory and terminated at said planar top surface;

wherein said second silhouette of said top stackable spray bottle comprises: a plurality of triangular depressions extended upwardly towards said first silhouette, said triangular depressions being spaced apart and having a planar bottom surface and a contoured outer perimeter edge beginning at said bottom portion and terminated at said planar bottom surface;

wherein, during storage, each of said triangular depressions of said top stackable spray bottle are removably nested directly on said triangular protrusions of said bottom stackable spray bottle, respectively.

7. The stackable spray bottle assembly of claim 3, wherein said first silhouette of said end cap of said bottom stackable spray bottle has a circular-shaped protrusion extended upwardly away from said accessory thereof, said circular-shaped protrusion covering a minor surface area of a top surface of said accessory, said circular-shaped protrusion having a planar top surface and an annular circumferential edge terminated at said planar top surface;

wherein said second silhouette of said top stackable spray bottle comprises:

a circular-shaped depression extended upwardly towards said accessory thereof, said circular-shaped depression covering a minor surface area of said bottom portion, said circular-shaped depression having a planar bottom surface and an annular circumferential edge terminated at said planar bottom surface, and a substantially square-shaped depression contiguously positioned with said circular-shaped depression, said substantially square-shaped depression and said circular-shaped depression covering a major surface area of said bottom portion, said substantially, square-shaped depression having a height that is lesser than a height of said circular-shaped depression;

wherein, during storage, said circular-shaped depression of said top stackable spray bottle is removably nested directly on said circular-shaped protrusion of said bottom stackable spray bottle, respectively, such that a gap is formed between said top surface of said accessory and said substantially square-shaped depression.

8. A stackable spray bottle assembly for being vertically stacked during storage, said stackable spray bottle assembly comprising:

a top stackable spray bottle and a bottom stackable spray bottle detachably engaged therewith, each of said top stackable spray bottle and said bottom stackable spray bottle including a reservoir having an open top portion and a closed bottom portion, and an accessory removably coupled to said open top portion;

wherein said accessory has a first silhouette;

wherein, during storage, said bottom portion has a second silhouette conforming to said first silhouette such that said top stackable spray bottle is maintained at a substantially stable position when stacked on top of said bottom stackable spray bottle;

wherein said reservoir has an interior volume greater than an interior volume of said accessory;

wherein said accessory includes one of a power-actuated trigger mechanism and a manually-actuated trigger mechanism;

wherein said accessory has a dispensing tip disposed at an outer perimeter of said reservoir as well as subjacent to a topmost surface of said reservoir such that said dispensing tip is exposed and operable when said top stackable spray bottle is stacked on top of said bottom stackable spray bottle;

wherein said dispensing tip is laterally spaced apart from said first silhouette and said second silhouette.

9. The stackable spray bottle assembly of claim 8, wherein said first silhouette of said bottom stackable spray bottle comprises: a plurality of triangular protrusions extended upwardly away from said accessory, said triangular protrusions being spaced apart and having a planar top surface and a contoured outer perimeter edge beginning at said accessory and terminated at said planar top surface;

wherein said second silhouette of said top stackable spray bottle comprises: a plurality of triangular depressions extended upwardly towards said first silhouette, said triangular depressions being spaced apart and having a planar bottom surface and a contoured outer perimeter edge beginning at said bottom portion and terminated at said planar bottom surface;

wherein, during storage, each of said triangular depressions of said top stackable spray bottle are removably nested directly on said triangular protrusions of said bottom stackable spray bottle, respectively.

10. The stackable spray bottle assembly of claim 8, wherein said first silhouette of said bottom stackable spray bottle comprises:

a plurality of rectilinear protrusions extended upwardly away from said accessory, said rectilinear protrusions being spaced apart and registered parallel to each other, each said rectilinear protrusions having an arcuate top surface extended along an entire longitudinal length thereof; and a handle having a dome-shaped top face intermediately positioned between said rectilinear protrusions and extended parallel to said rectilinear protrusions;

wherein said second silhouette of said top stackable spray bottle comprises: a plurality of rectilinear depressions extended upwardly away from said accessory, said rectilinear depressions being spaced apart and registered parallel to each other, each said rectilinear depressions having an arcuate top surface extended along an entire longitudinal length thereof; and a dome-shaped handle-receiving channel intermediately positioned between said rectilinear depressions and extended parallel to said rectilinear depressions;

wherein, during storage, each of said rectilinear depressions and said dome-shaped handle-receiving channel of said top stackable spray bottle are removably nested directly on said rectilinear protrusions and said handle of said bottom stackable spray bottle, respectively.

11. The stackable spray bottle assembly of claim 8, wherein said first silhouette of said bottom stackable spray bottle comprises: a boomerang-shaped protrusion extended upwardly away from said accessory thereof, said boomerang-shaped protrusion covered a major surface area of a top surface of said accessory, said boomerang-shaped protrusion having a planar top surface and a contoured outer perimeter edge beginning at said accessory and terminated at said planar top surface;

wherein said second silhouette of said top stackable spray bottle comprises: a boomerang-shaped depression extended upwardly towards said accessory thereof, said boomerang-shaped depression covering a major surface area of said bottom portion, said boomerang-shaped depression having a planar bottom surface and a contoured outer perimeter edge beginning at said bottom portion and terminated at said planar bottom surface;

wherein, during storage, said boomerang-shaped depression of said top stackable spray bottle is removably nested directly on said boomerang-shaped protrusion of said bottom stackable spray bottle, respectively.

12. The stackable spray bottle assembly of claim 8, wherein said first silhouette of said bottom stackable spray bottle comprises: a generally square-shaped protrusion extended upwardly away from said accessory thereof, said generally square-shaped protrusion coveting a major surface area of a top surface of said accessory, said generally square-shaped protrusion having a planar top surface and a contoured outer perimeter edge beginning at said accessory and terminated at said planar top surface;

wherein said second silhouette of said top stackable spray bottle comprises: a generally square-shaped depression extended upwardly towards said accessory thereof, said generally square-shaped depression covering a major surface area of said bottom portion, said generally square-shaped depression having a planar bottom surface and a contoured outer perimeter edge beginning at said bottom portion and terminated at said planar bottom surface;

wherein, during storage, said generally square-shaped depression of said top stackable spray bottle is removably nested directly on said generally square-shaped protrusion of said bottom stackable spray bottle, respectively.

13. The stackable spray bottle assembly of claim 8, wherein said first silhouette of said end cap of said bottom stackable spray bottle has a circular-shaped protrusion extended upwardly away from said accessory thereof, said circular-shaped protrusion covering a minor surface area of a top surface of said accessory, said circular-shaped protrusion having a planar top surface and an annular circumferential edge terminated at said planar top surface;

wherein said second silhouette of said top stackable spray bottle comprises:

a circular-shaped depression extended upwardly towards said accessory thereof, said circular-shaped depression covering a minor surface area of said bottom portion, said circular-shaped depression having a planar bottom surface and an annular circumferential edge terminated at said planar bottom surface, and a substantially square-shaped depression contiguously positioned with said circular-shaped depression, said substantially square-shaped depression and said circular-shaped depression covering a major surface area of said bottom portion, said substantially square-shaped depression having a height that is lesser than a height of said circular-shaped depression;

wherein, during storage, said circular-shaped depression of said top stackable spray bottle is removably nested directly on said circular-shaped protrusion of said bottom stackable spray bottle, respectively, such that a gap is formed between said top surface of said accessory and said substantially square-shaped depression.

* * * * *